US007685943B2

(12) United States Patent
Caro et al.

(10) Patent No.: US 7,685,943 B2
(45) Date of Patent: Mar. 30, 2010

(54) TRAVELING DUCT FOR CARRYING EXHAUST CAPTURED FROM MOVING DIESEL-POWERED LOCOMOTIVES

(76) Inventors: Sal Caro, 122 Tranquilla Dr., Camarillo, CA (US) 93012; Kevin Connolly, 5338 Gillespie St., Ventura, CA (US) 93003; Jason McAuley, 697 Bluewater Way, Port Hueneme, CA (US) 93041

( * ) Notice: Subject to any disclaimer, the term of this patent is extended or adjusted under 35 U.S.C. 154(b) by 323 days.

(21) Appl. No.: 11/406,217

(22) Filed: Apr. 18, 2006

(65) Prior Publication Data

US 2007/0209545 A1 Sep. 13, 2007

Related U.S. Application Data

(63) Continuation-in-part of application No. 11/370,373, filed on Mar. 8, 2006.

(51) Int. Cl.
*E04H 6/00* (2006.01)
*E21F 1/00* (2006.01)

(52) U.S. Cl. ..... 104/52; 454/166

(58) Field of Classification Search ..... 104/51, 104/52; 454/64, 166, 167
See application file for complete search history.

(56) References Cited

U.S. PATENT DOCUMENTS 4,086,847 A * 5/1978 Overmyer ..... 454/64
4,567,817 A * 2/1986 Fleischer et al. ..... 454/166
4,660,465 A * 4/1987 Jentzsch et al. ..... 454/64
4,744,305 A * 5/1988 Lim et al. ..... 104/52
5,655,962 A * 8/1997 Pfeiffer et al. ..... 454/64
6,361,427 B1 * 3/2002 Sjoberg ..... 454/64

* cited by examiner

*Primary Examiner*—S. Joseph Morano
*Assistant Examiner*—Robert J McCarry, Jr.
(74) *Attorney, Agent, or Firm*—Kenneth L. Green; Edgar W. Averill, Jr.

(57) ABSTRACT

A traveling duct allows a bonnet to remain over the exhaust pipes of diesel-powered locomotives in motion, and to remain in fluid communication with an Emissions Control Unit (ECU). The bonnet includes a shell with a compliant fender for enclosing the exhaust pipes. One or more of the bonnets are positioned over the exhaust pipe or pipes of the locomotive and are secured to the exhaust pipes or to a top surface of the locomotive. The traveling duct includes an outer duct having a bottom gap or slot. The bonnets may either be connected to an extendable inner duct within the traveling duct, or to a duct transport unit slidably residing within the traveling duct. Exhaust from the locomotive is captured by the bonnet and fed from the bonnet into the traveling duct. The exhaust is then carried by the traveling duct to the ECU for processing.

17 Claims, 20 Drawing Sheets

TRAVELING DUCT FOR CARRYING EXHAUST CAPTURED FROM MOVING DIESEL-POWERED LOCOMOTIVES

The present application is a Continuation In Part of U.S. patent application Ser. No. 11/370,373, filed Mar. 8, 2006 for "Exhaust Intake Bonnet for Capturing Exhausts from Diesel-powered Locomotives", which application is incorporated herein by reference.

BACKGROUND OF THE INVENTION

The present invention relates to capturing exhaust gases from moving diesel locomotives and in particular to a duct transport unit traveling along a horizontal duct allowing a bonnet to remain in place over a locomotive exhaust pipe of a railroad locomotive in motion at a slow speed.

Railroad locomotives generally have a large diesel engine coupled to a generator which provides power to drive motors attached to the locomotive's wheels. For example, a General Motors FP 59 diesel electric locomotive has a 12 cylinder main diesel engine producing approximately 3200 hp. The FP 59 locomotive also includes a second smaller 12 cylinder diesel engine for providing electricity for air conditioning, lights, kitchen facilities, and other auxiliary requirements of a train.

Substantial quantities of pollutants are produced by locomotives burning diesel fuels. The exhaust produced by an engine burning these fuels is a complex mixture of tens of thousands of gases and fine particulates. The particulates, which make up the commonly observed discharges known as soot or smoke, contain more than forty toxic air contaminants. The exhaust may include arsenic, benzene, and formaldehyde along with other ozone-forming pollutants that are components of smog and acid rain, such as sulfur dioxide ($SO_2$) and nitrogen oxides (NOx). Such contaminates create a substantial health risk to railroad workers and residents of surrounding communities and may physically damage structures and equipment.

Studies of diseases and health problems tied to air-borne pollutants, including various forms of cancer, have identified geographic clusters with occurrences of such diseases and health problems significantly higher than statistical norms. These geographic clusters have been shown to conform closely to the geographic distribution of emissions plumes from railroad yards and test facilities. Although these health issues have been identified, there is presently no effective system for capturing locomotive emissions in these areas.

BRIEF SUMMARY OF THE INVENTION

The present invention addresses the above and other needs by providing a duct transport unit traveling along a horizontal duct which allows a bonnet to remain over the exhaust pipes of diesel-powered locomotives in motion, and to remain in fluid communication with an Emissions Control Unit (ECU). The bonnet includes a shell with a compliant fender for enclosing the exhaust pipes. One or more of the bonnets are positioned over the exhaust pipe or pipes of the locomotive and are secured to the exhaust pipes or to a top surface of the locomotive. The horizontal duct includes an outer duct having a bottom gap or slot. The bonnets may either be connected to an extendable inner duct within the outer duct, or to a duct transport unit slidably residing within the outer duct. Exhaust from the locomotive is captured by the bonnet and fed from the bonnet into the horizontal duct. The exhaust is then carried by the horizontal duct to the ECU for processing.

In accordance with one aspect of the invention, there is provided a locomotive exhaust control system for processing exhaust from a moving locomotive. The system includes an Emissions Control Unit (ECU) for processing locomotive exhaust, a horizontal duct residing above a train track and in fluid communication with the ECU, and a bonnet adapted for residing over a locomotive exhaust pipe for capturing locomotive exhaust. The horizontal duct includes an outer duct having a lengthwise running slot. A vertical duct places the bonnet in fluid communication with the horizontal duct, is adapted to translate along the horizontal duct, and is vertically adjustable to allow positioning the bonnet over the exhaust pipe. A duct transport unit interfaces the vertical duct to the horizontal duct and translates along the horizontal duct with the vertical duct. A seal closes the slot in front of the duct transport unit and behind the duct transport unit.

In accordance with another aspect of the invention, there is provided a locomotive exhaust control system for capturing and processing exhaust from a stationary or moving locomotive. The system includes an Emissions Control Unit (ECU) for processing locomotive exhaust, a horizontal duct residing above a train track and in fluid communication with the ECU, and a bonnet adapted for residing over a locomotive exhaust pipe for capturing locomotive exhaust. The horizontal duct includes an outer duct having a lengthwise running slot. A vertical duct places the bonnet in fluid communication with the horizontal duct, wherein the vertical duct is adapted to translate along the horizontal duct and is vertically adjustable to allow positioning the bonnet over the exhaust pipe. An extendable inner duct residing inside the outer duct interfaces the vertical duct with the horizontal duct, and the extendable inner duct extends and compresses within the outer duct to allow motion of the vertical duct along the horizontal duct

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

Figure 1:
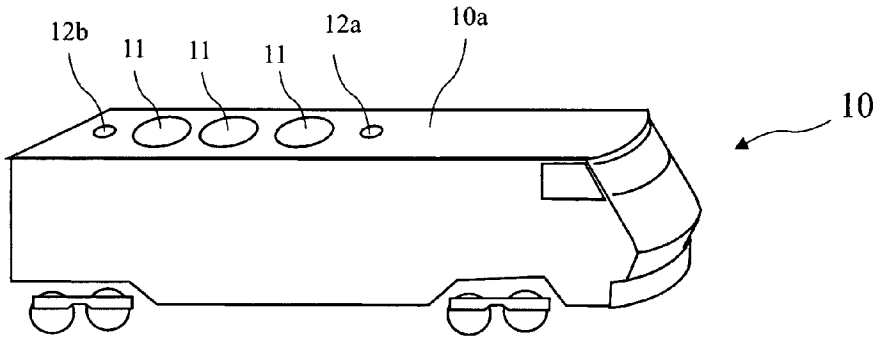
FIG. 1 is a locomotive suitable for use with the present invention.

The following description is of the best mode presently contemplated for carrying out the invention. This description is not to be taken in a limiting sense, but is made merely for the purpose of describing one or more preferred embodiments of the invention. The scope of the invention should be determined with reference to the claims.

The present invention comprises a horizontal (or traveling) duct for carrying captured diesel locomotive exhaust. Recent studies of diseases and health problems tied to air-borne pollutants, including various forms of cancer, have identified geographic clusters with occurrences of such diseases and health problems significantly higher than statistical norms. These geographic clusters have been shown to conform closely to the geographic distribution of emission plumes from railroad yards and test facilities. The present invention provides an important element of a system for controlling emissions from diesel locomotives while moving slowly (or stationary) within a rail yard with engines idling or operating at low power (Notch 2). By capturing and processing most or all of the exhaust gases for subsequent treatment, the exhaust intake bonnet and exhaust processing system of the present invention permits a significant reduction of particulate matter (PM), nitrogen oxides (NOx), sulfur dioxide ($SO_2$) and volatile organic compounds (VOCs). The present invention may further be utilized to reduce locomotive emissions resulting from port side loading and unloading of containers onto railcars at seaports, or from any activity wherein a locomotive resides in a small area for periods or time with the locomotive engine(s) running.

A similar problem is the emissions from ocean going vessels. U.S. patent application Ser. No. 10/835,197, filed Apr. 29, 2004 for "Maritime Emissions Control System," and assigned to the assignee of the present invention, describes a maritime emissions control system which may be transported by barge or vessel to an Ocean Going Vessel (OGV) near or within a harbor. The maritime emissions control system captures and processes a main exhaust flow from the OGV to reduce emissions. The main exhaust flow may be from the OGV's engine(s), auxiliary engines, generators, and/or any other source of exhaust from the OGV. The '197 application is herein incorporated by reference.

U.S. patent application Ser. No. 10/941,731, filed Sep. 14, 2004 for "High Thermal Efficiency Selective Catalytic Reduction (SCR) System," and assigned to the assignee of the present invention, describes an emissions control unit which transfers heat generated in one or more parts of the SCR system which generate heat to other parts of the SCR system which require heat. For example, heat stored in exhaust from a diesel generator is used to convert urea to ammonia used by the SCR system, and/or the diesel generator exhaust may be used to heat the main exhaust flow before entry into the SCR system. Additionally, a heat exchanger is used to transfer heat from a hot clean flow out of the SCR system to the main exhaust flow entering the SCR system. The '731 application is herein incorporated by reference.

US patent application filed on Mar. 28, 2005 titled "Air Pollution Control System for Ocean-Going Vessels," and assigned to the assignee of the present invention, describes an emissions control unit having a first system adapted to receive a dirty flow and reduce Particulate Matter (PM) and Sulfur Dioxide ($SO_2$) in the dirty flow to produce a first processed flow from the first system and a second system adapted to receive the first processed flow and to reduce Oxides of Nitrogen ($NO_x$) in the first processed flow to produce a second processed flow from the second system. The first system and the second system are connected to serially process a gaseous flow to reduce PM, $SO_2$, and $NO_x$ in the flow, and by first reducing the PM, $SO_2$ before the flow enters the $NO_x$ reducing system, the reliability and efficiency of the $NO_x$ reducing system is improved. The system further teaches the use of heat in exhaust from a diesel generator to convert aqueous ammonia, or urea, to ammonia for a selective catalytic reducer, thus reducing energy costs. The application filed Mar. 28, 2005 is herein incorporated by reference.

U.S. patent application Ser. No. 11/370,373 titled "Exhaust Intake Bonnet for Capturing Exhausts from Diesel-powered Locomotives" describes a bonnet suitable for placing over a locomotive exhaust pipe (or stack). The horizontal duct of the present invention allows the bonnet to remain over the exhaust pipe while the locomotive is in motion, and allows the duct to remain in fluid communication with an Emissions Control Unit (ECU) while the locomotive is in motion. The 373 application is herein incorporated by reference.

The present invention applies similar principles as described in the above incorporated patent applications to the control of emissions from a diesel locomotive 10 as shown in FIG. 1. The locomotive 10 has at least one exhaust pipe 12*a* for a main engine, and often has a second exhaust pipe 12*b* for an auxiliary engine, for example, for an auxiliary engine supplying power to train cars. Such locomotives 10 may produce a large volume of diesel exhaust while operating. When the locomotive 10 is traveling between destinations the diesel exhaust may be diluted into the air. However, when the diesel locomotive 10 is parked or moving slowly at a train station, at a port or other loading/unloading location, or at a test facility, a large amount of diesel exhaust may be released into a smaller area and present a health risk. This problem is compounded by the fact that locomotive engines are often left running for long periods of time versus stopping and restarting the engines.

Figure 2:
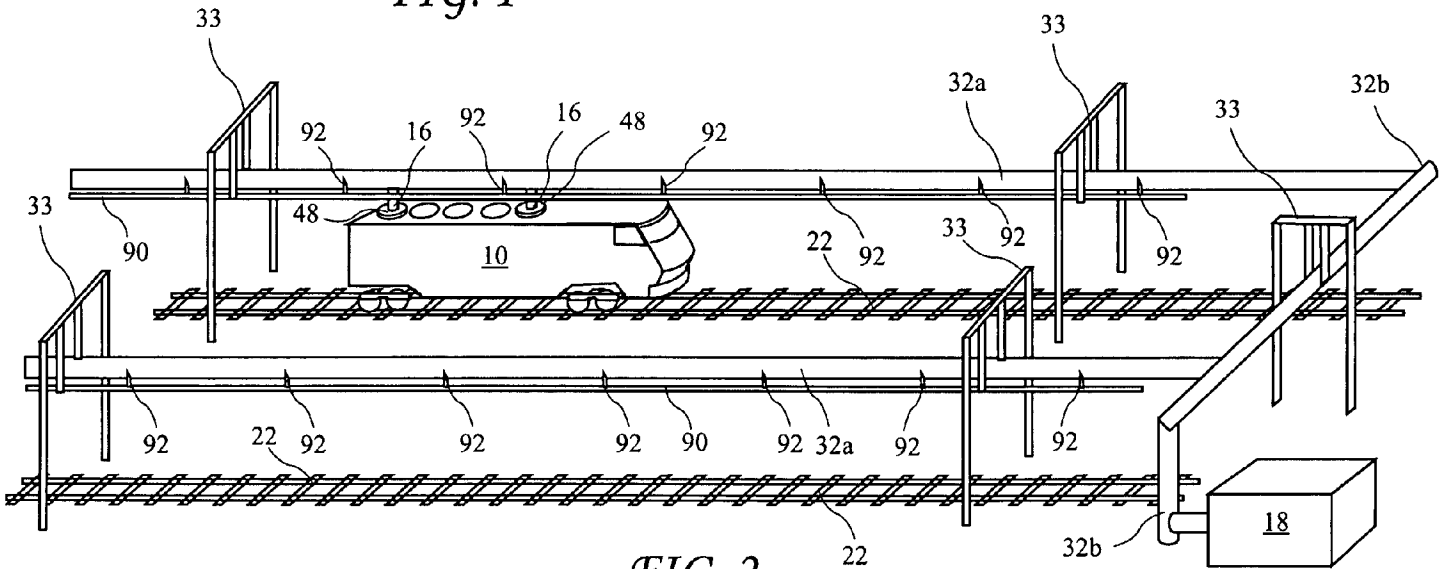
FIG. 2 depicts a manifold system according to the present invention for collecting locomotive exhaust and carrying the exhaust to an Emissions Control Unit (ECU).

A system according to the present of the invention for capturing and processing diesel locomotive exhaust is shown in FIG. 2. The system includes a bonnet 48 (see FIGS. 3A and 3B), an Emissions Control Unit (ECU) 18, and a manifold for carrying the locomotive exhaust from the bonnet 48 to the ECU 18. The manifold comprises a system of horizontal ducts 32*a* and connecting ducts 32*b*. The horizontal ducts 32*a* and/or the connecting ducts 32*b* are preferably supported by an overhead structure 33, rails 90, and duct supports 92. The horizontal ducts 32*a* run parallel to train tracks 22, are preferably approximately centered above the train tracks 22, and are high enough to allow the diesel locomotive 10 to run under the horizontal ducts 32*a*.

Figure 5B:
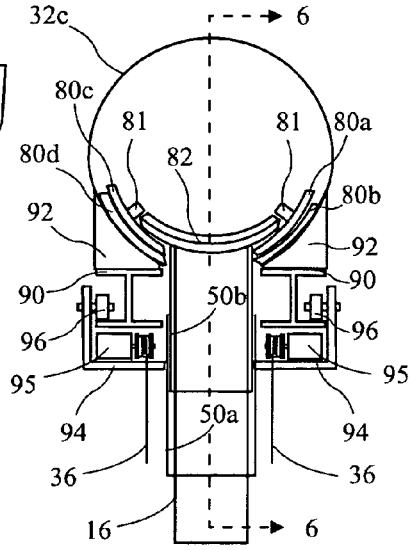
FIG. 5B is a cross-sectional view of the horizontal duct with a duct transport unit opening the slot by sliding the tiles laterally aside, taken along line 5B-5B of FIG. 4.
Figure 8B:
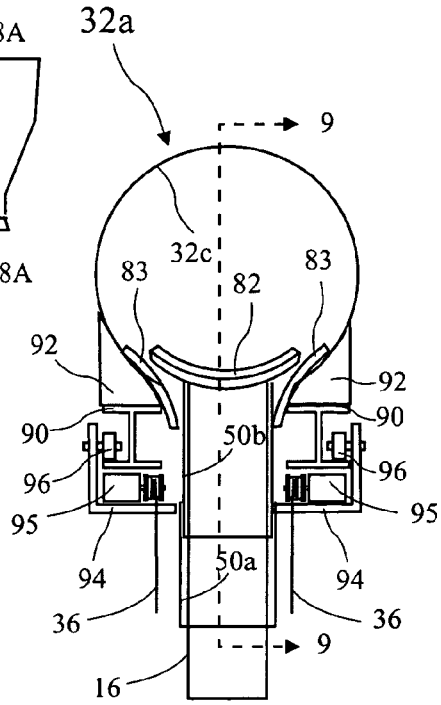
FIG. 8B is a cross-sectional view of the horizontal duct with the duct transport unit opening the slot by sliding between the opposing flaps, taken along line 8B-8B of FIG. 7.

Each horizontal duct 32*a* includes an outer duct 32*c* having a slot (or bottom gap) 84 (see FIG. 5A) running along (or parallel to) it's bottom and running substantially (need not extend to the ends) the length of the outer duct 32*c*, and means for containing the captured exhaust in the horizontal duct, i.e., for preventing the exhaust from escaping through the slot 84. The bonnet 48 includes or is attached to an extending and retracting vertical duct 16 (preferably supported by telescoping sections 50*a* and 50*b* as shown in FIGS. 5B and 8B) or an extendable vertical duct 70 (see FIG. 3B). Any structure which allows the vertical duct to extend and contract in length to allow the bonnet 48 to be lowered against a locomotive or lifted away from a locomotive is suitable for use as the vertical duct. The vertical duct 16 or 70 is connected to a duct transport unit 82 slidably residing in or on the horizontal duct 32*a* (see FIGS. 5B, 8B), or connected to an extendable inner duct 86 (see FIG. 11B) residing in the outer duct 32*c*. The duct transport unit 82 is adapted to slide inside and/or outside the horizontal duct 32*a* and to open a seal 80 or 83 (see FIGS. 5B and 8B) as the duct transport unit 82 slides past, wherein the seal 80 or 83 closes behind the duct transport unit 82 to allow for motion of the locomotive 10. The extendable inner duct 86 extends and compresses longitudinally within the outer duct 32*c* to allow for motion of the locomotive 10.

The ECU 18 preferably provides a significant reduction of Particulate Matter (PM), Nitrogen Oxides ($NO_x$), Sulfur Dioxide ($SO_2$), and Volatile Organic Compounds (VOCs). An ECU 18 providing such reduction is described in US patent application filed on Mar. 28, 2005 titled "Air Pollution Control System for Ocean-Going Vessels," incorporated by reference above.

Figure 3A:
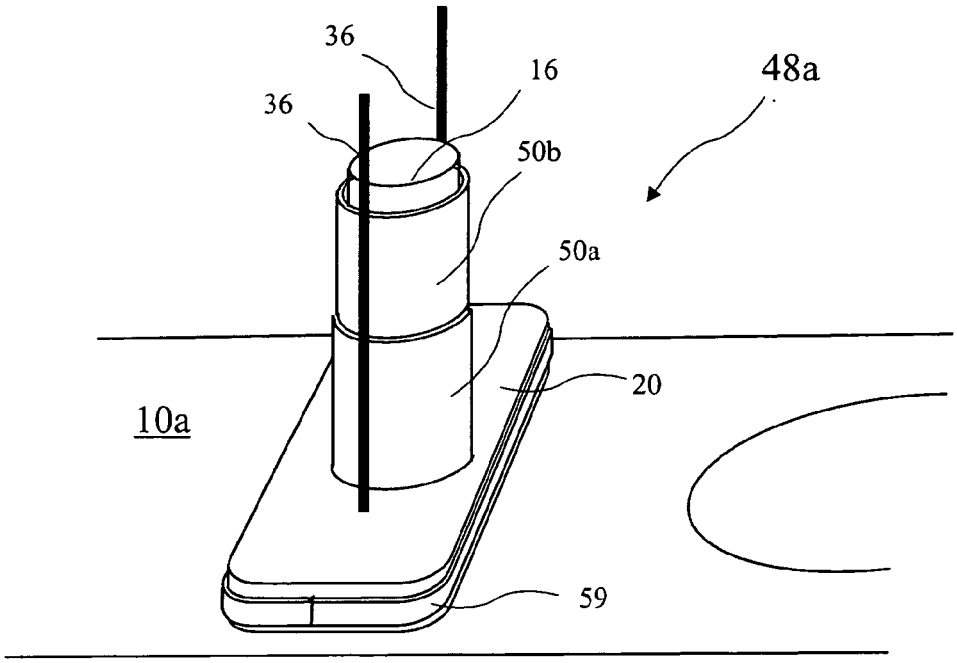
FIG. 3A is a perspective view of a first bonnet for collecting locomotive exhaust according to the present invention.

A perspective view of a first bonnet 48*a* is shown in FIG. 3A. Vertical duct supports 50*a* and 50*b* support the vertical duct 16. The vertical duct 16 may be a telescoping duct or an expanding and contracting duct to allow the bonnet 48*a* to be lowered against the locomotive 10 or raised away from the locomotive 10. Bonnet supports 36 are attached to the shell 20 for positioning the bonnet 48*a* over the exhaust pipes 12*a* and 12*b*. The bonnet supports 36 may comprise, for example, cables, lever arms, gear mechanisms, and/or hydraulic mechanisms, and are preferably cables, and may be used to guide the lowering of the bonnet 48*a* over the exhaust pipes 12*a* and 12*b*, and the raising of the bonnet 48*a* from the exhaust pipes 12*a* and 12*b*. The vertical duct supports 50*a* and 50*b* are preferably telescoping structures.

Figure 3B:
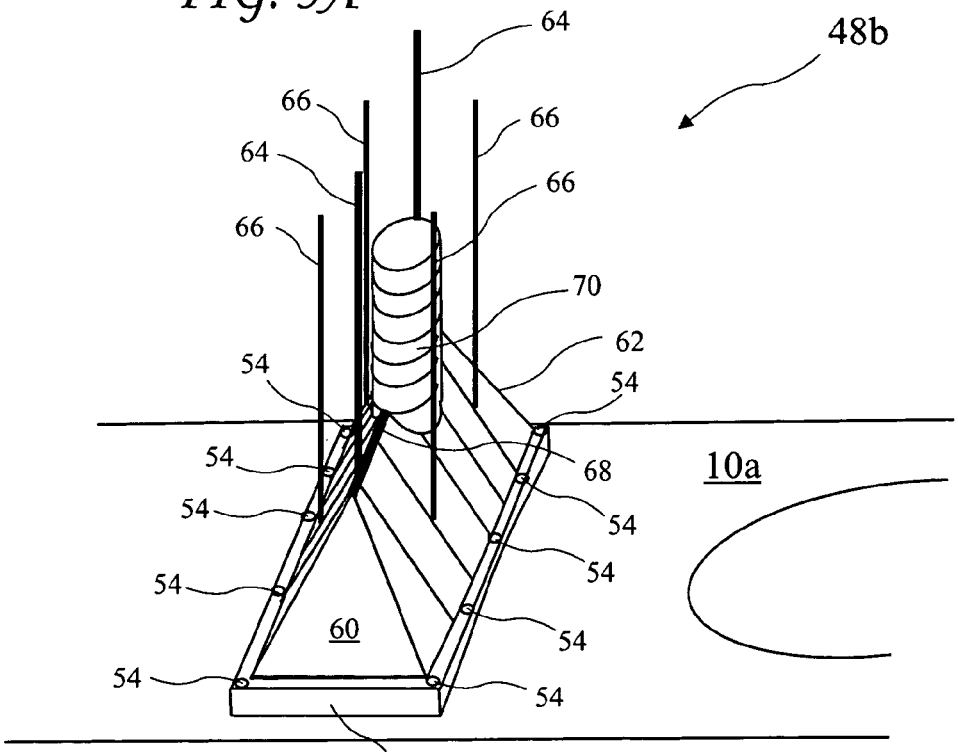
FIG. 3B is a perspective view of a second bonnet for collecting locomotive exhaust according to the present invention.

A perspective view of a second embodiment of a bonnet 48*b* according to the present invention is shown in FIG. 3B. The second bonnet 48*b* comprises a tent 60 formed over or attached to a frame 62. The frame 62 is connected to a hinge 68 preferably running along the peak of the frame 62. First cables 64 are attached to the hinge 68 and second cables 66 are attached to the frame 62 to provide vertical support to the hinge 68 and the frame 62 independently. The cables 64, 66 may be independently raised and lowered, thereby causing the frame 62 to pivot about the hinge 68, thereby widening and narrowing the frame 62. A compliant fender 56 resides on a lower edge of the tent 60. The tent 60 and the fender 56 follow the widening and narrowing the frame 62 thereby widening and narrowing the tent 60 to accommodate the locomotive 10. Magnets 54 reside in the fender 56 or in the base of the tent 60 to hold the bonnet 48*b* in place on the locomotive 10. The bonnet 48*b* includes a second vertical duct 70 which places the bonnet 48*b* in fluid communication with the horizontal duct 32*a*. The vertical duct 70 may be a telescoping duct or an expanding and contracting duct to allow the bonnet 48*b* to be lowered against the locomotive 10 or raised away from the locomotive 10.

While the bonnets 48*a* and 48*b* are depicted in fluid cooperation with horizontal duct 32*a* and the vertical ducts 16, 70, in general, the horizontal duct 32*a* need not be precisely above the bonnet 48*a* or 48*b*, and an attaching duct may be used to place the bonnet 48*a* and 48*b* in fluid communication with the horizontal duct 32*a*, wherein the attaching duct is adapted to translate longitudinally along the horizontal duct 32*a*.

Figure 4:
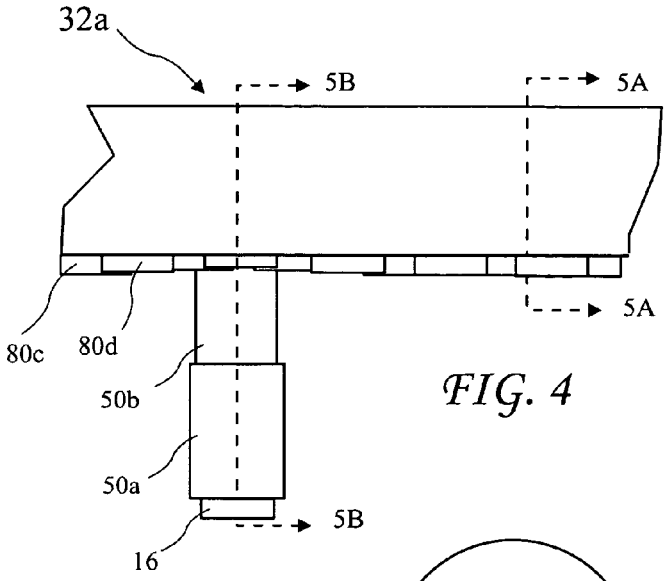
FIG. 4 is a side view of a horizontal duct according to the present invention with opposing tiles closing a slot in an outer duct.
Figure 5A:
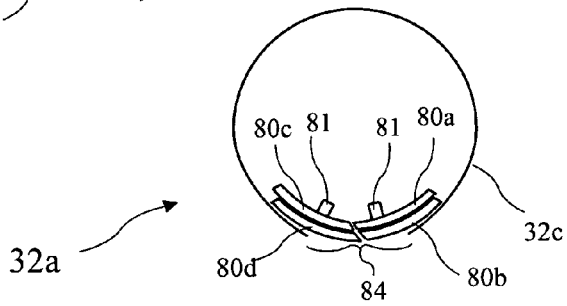
FIG. 5A is a cross-sectional view of the horizontal duct with the tiles closing the slot, taken along line 5A-5A of FIG. 4.

A side view of a portion of the horizontal duct 32*a* showing longitudinally cooperating opposing tiles 80*c* and 80*d* closing a slot 84 (see FIG. 5A) is shown in FIG. 4. The slot 84 is provided to allow the vertical duct 16 or 70 to fluidly communicate with the horizontal duct 32*a*. A cross-sectional view of the horizontal duct 32*a* taken along line 5A-5A of FIG. 4 is shown in FIG. 5A with the tiles 80*a*-80*d* closing the slot 84 of the outer duct 32*c*. The tiles 80*a*-80*d* comprise upper tile 80*a*, lower tile 80*b*, opposing upper tile 80*c*, and opposing lower tile 80*d* which cooperate to close the slot 84. A second cross-sectional view of the horizontal duct 32*a* taken along line 5B-5B of FIG. 4 is shown in FIG. 5B with a duct transport unit 82 pushing against bumpers 81 to separate the tiles 80*a*-80*d* to open the slot 84 to create a translating opening for the vertical duct 16 or 70 and the vertical duct supports 50*a* and 50*b*.

Figure 6:
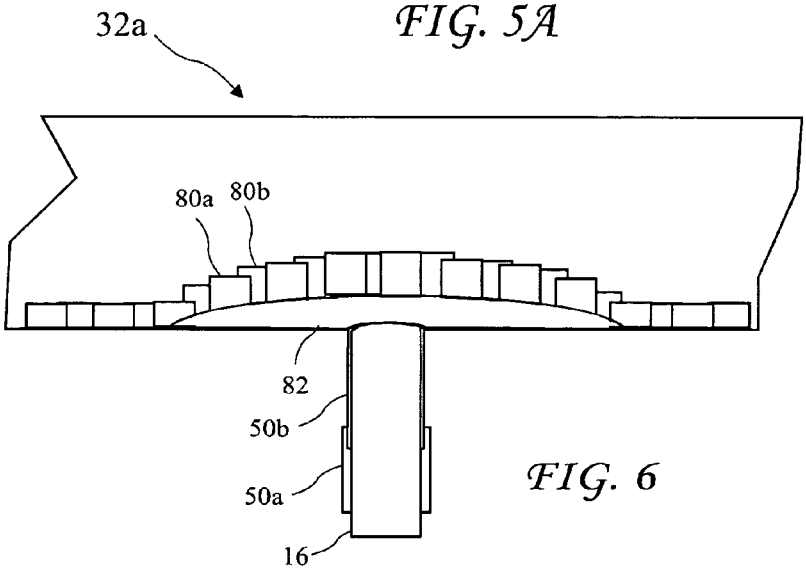
FIG. 6 is a cross-sectional view of the horizontal duct taken along line 6-6 of FIG. 5B, with the duct transport unit pushing the tiles away from the slot.

A cross-sectional view taken along line 6-6 of FIG. 5B is shown in FIG. 6. The duct transport unit 82 pushed the tiles 80*a*, 80*b* to the side and up an interior wall of the outer duct 32*c* (see FIG. 5A), thus creating an opening for the vertical duct 16 or 70 and the vertical duct supports 50*a* and 50*b*.

The horizontal duct 32*a* is supported by rails 90 and through duct supports 92 (also see FIG. 2). The vertical duct 16 or 70 and the vertical duct supports 50*a* and 50*b* are supported by vertical duct supports 94 which rides on the rails 90 using rollers or wheels 96. The rails 90 thus both support the horizontal duct 32*a* in a stationary manner and the vertical duct 16 or 70 and the vertical duct supports 50*a* and 50*b* in a translating manner, and thus further supports the bonnet 48 attached to the vertical duct 16 or 70. The vertical duct supports 94 may simply provide vertical support and the motion of the locomotive 10 may "drag" the vertical duct 16 or 70 and the vertical duct supports 50*a* and 50*b* (and the attached duct transport unit 82), or a motor or cable may be provided to actively maintain the vertical duct 16 or 70 and the vertical duct supports 50*a* and 50*b* above the exhaust pipe 12*a* or 12*b* (see FIGS. 30A and 30B).

Figure 7:
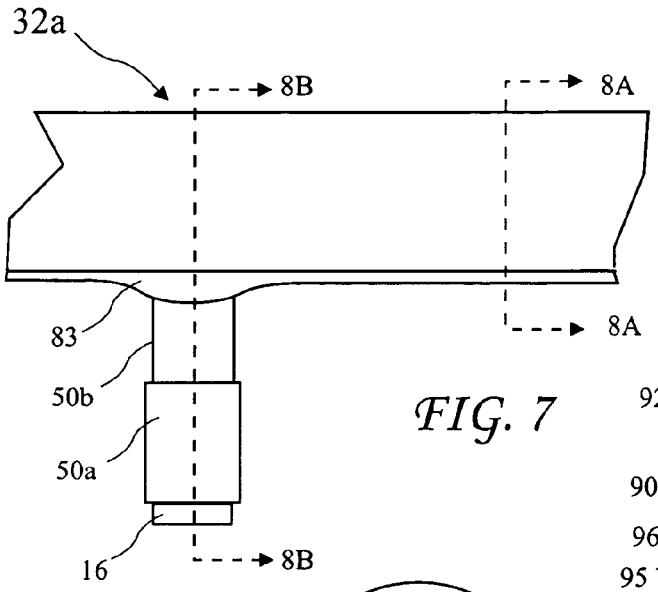
FIG. 7 is a side view of the horizontal duct according to the present invention with opposing flaps closing a slot in the outer duct.
Figure 8A:
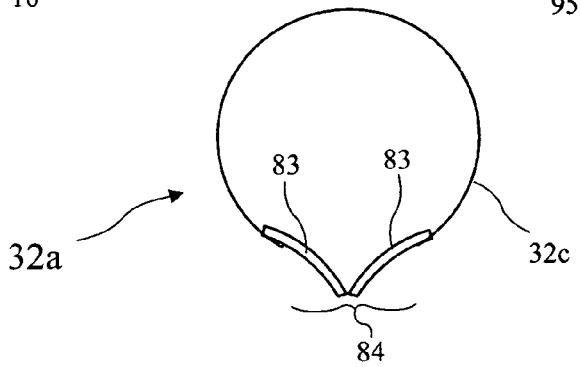
FIG. 8A is a cross-sectional view of the horizontal duct with the opposing flaps closing the slot, taken along line 8A-8A of FIG. 7.

A side view of a portion of the horizontal duct 32*a* showing flaps 83 closing the slot 84 (see FIG. 8A) is shown in FIG. 7. A cross-sectional view of the horizontal duct 32*a* taken along line 8A-8A of FIG. 7 is shown in FIG. 8A wherein a seal comprises two flaps 83 which extend from the sides of the gap 84 downward and towards each other so as to normally close against each other and thereby close the gap 84. Because the pressure within the horizontal duct 32*a* is preferably slightly negative, this negative pressure will tend to keep the flaps 83 closed against each other. If any over-pressure or surge of pressure occurs in the manifold system, the flaps 83 may separate and release the pressure. A cross-sectional view of the horizontal duct 32*a* taken along line 8B-8B of FIG. 7 is shown in FIG. 8B with a duct transport unit 82 pushing the flaps 83 open to separate the flaps 83 to open the slot 84 to create a translating opening for the vertical duct 16 or 70. The flaps 83 will separate and close against the vertical duct 16 or 70 and the vertical duct supports 50*a* and 50*b* or the duct transport unit 82 as it passes, and close behind the vertical duct 16 or 70 and the vertical duct supports 50*a* and 50*b* or the duct transport unit 82 after it passes.

Figure 9:
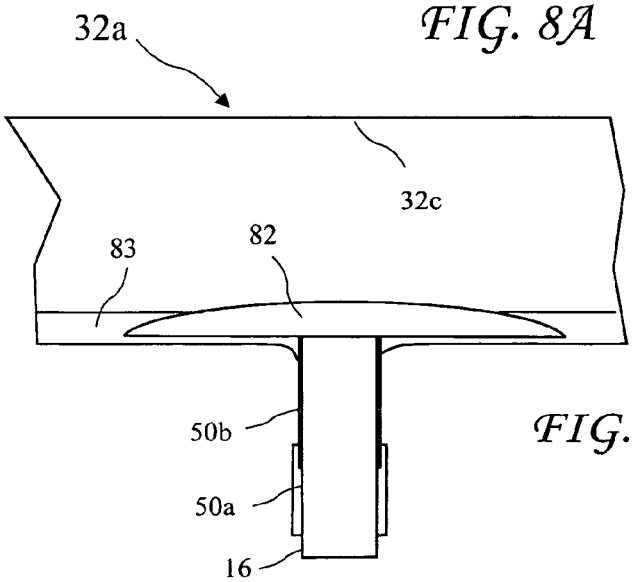
FIG. 9 is a cross-sectional view of the traveling duct taken along line 9-9 of FIG. 8B, with the duct transport unit pushing one of the flaps away from the slot.

A cross-sectional view taken along line 9-9 of FIG. 8B is shown in FIG. 9. The vertical duct 16 or 70 and the vertical duct supports 50*a* and 50*b* and/or the duct transport unit 82 pushes the flap 83 to the side, thus creating an opening for the vertical duct 16 or 70 and the vertical duct supports 50*a* and 50*b*.

Figure 10:
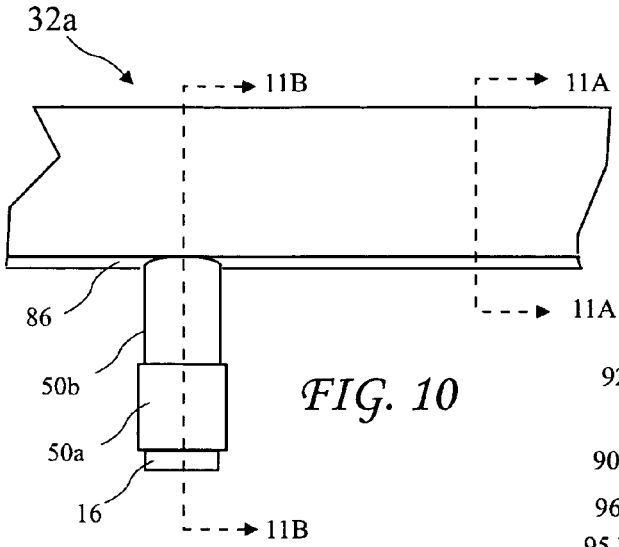
FIG. 10 is a side view of the horizontal duct according to the present invention with an extendable inner duct residing in the outer duct.
Figure 11B:
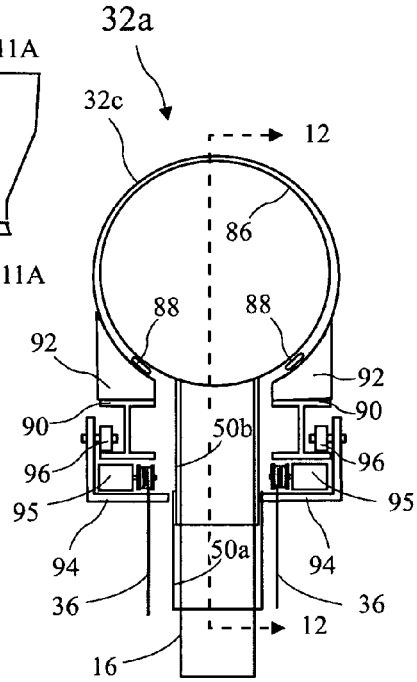
FIG. 11B is a cross-sectional view of the horizontal duct with the vertical duct extending from the extendable inner duct, taken along line 11B-11B of FIG. 10.
Figure 11A:
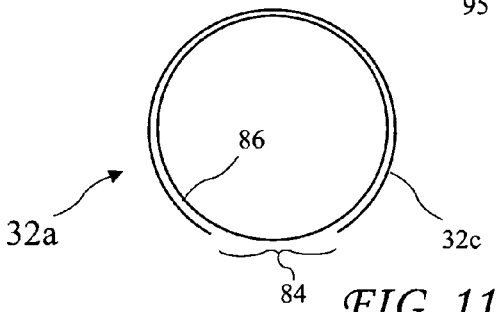
FIG. 11A is a cross-sectional view of the horizontal duct with the extendable inner duct closing the slot in the outer duct, taken along line 11A-11A of FIG. 10.

A side view of a portion of the horizontal duct 32*a* showing the vertical duct 16 or 70 and the vertical duct supports 50*a* and 50*b* extending down from an extendable inner duct 86 is shown in FIG. 10. A cross-sectional view of the horizontal duct 32*a* taken along line 11A-11A of FIG. 10 is shown in FIG. 11A wherein the extendable inner duct 86 forms a closed circle, thereby closing the slot 84. A cross-sectional view of the horizontal duct 32*a* taken along line 11B-11B of FIG. 10 is shown in FIG. 11B wherein the vertical duct 16 or 70 and the vertical duct supports 50*a* and 50*b* are extending downward from the extendable inner duct 86. Slides or rollers 88 support the extendable inner duct 86 proximal to the attachment of the duct 16 or 70 to the extendable inner duct 86.

Figure 12:
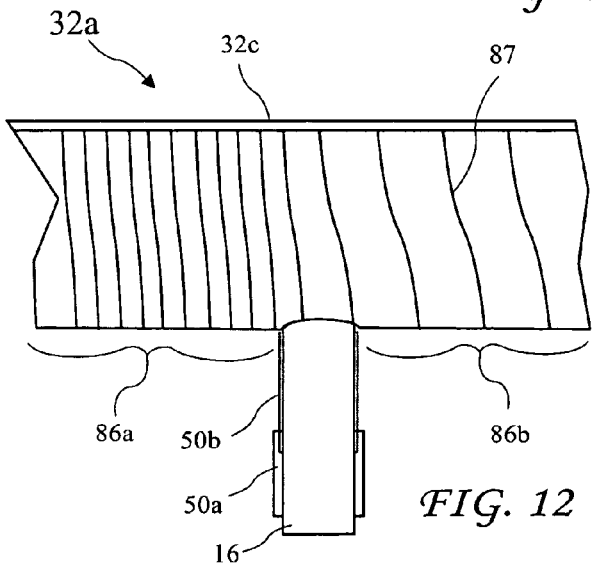
FIG. 12 is a cross-sectional view of the horizontal duct taken along line 12-12 of FIG. 11B, with the vertical duct extending down from the extendable inner duct.

A cross-sectional view taken along line 12-12 of FIG. 11B is shown in FIG. 12. The vertical duct 16 or 70 and the vertical duct supports 50*a* and 50*b* are attached to the extendable inner duct 86 and extend downward through the slot 84 to the bonnet 48. The extendable inner duct 86 expands and compresses as the vertical duct 16 or 70 and the vertical duct supports 50*a* and 50*b* translate longitudinally along the horizontal duct 32*a*. A compressed portion 86*a* of the extendable inner duct 86 is shown to the left of the vertical duct 16 or 70 and a less compressed (or expanded) portion 86*b* of the extendable inner duct 86 is shown to the right of the vertical duct 16 or 70 and the vertical duct supports 50*a* and 50*b*. The extendable inner duct 86 preferably comprises a high-strength fiberglass cloth fully impregnated with an ultra-high temperature silicone compound and is preferably clinched within an external stainless steel helix 87. While an outer duct 32*c* is depicted in FIGS. 11A, 11B, and 12, it is not necessary to enclose extendable inner duct 86 to seal the horizontal duct 32*a*. The outer duct 32*c* may be replaced by any outer duct support having sufficient structure to support the extendable inner duct 86.

Figure 13A:
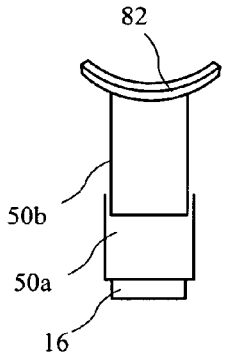
FIG. 13A is a front view of the duct transport unit.
Figure 13B:
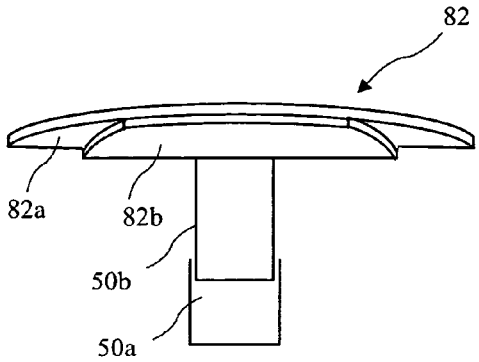
FIG. 13B is a side view of the duct transport unit.
Figure 13C:
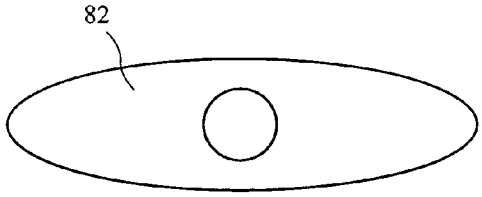
FIG. 13C is a top view of the duct transport unit.

A front view of the duct transport unit 82 is shown in FIG. 13A, a side view of the duct transport unit 82 is shown in FIG. 13B, a top view of the duct transport unit 82 is shown in FIG.

Figure 13D:
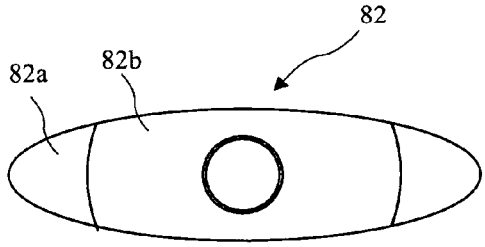
FIG. 13D is a bottom view of the duct transport unit.

13C, and a bottom view of the duct transport unit 82 is shown in FIG. 13D. The duct transport unit 82 includes a low friction sliding surface 82*b* for sliding on the interior wall of the outer duct 32*c* and a transport unit bumper 82*a* for cooperating with the tile bumpers 81 (see FIG. 5B) to push the tiles 80 apart to allow the vertical duct 16 or 70 and the vertical duct supports 50*a* and 50*b* and/or the duct transport unit 82 to pass. The transport unit bumper 82*a* preferably has an elliptical shape.

Figure 14A:
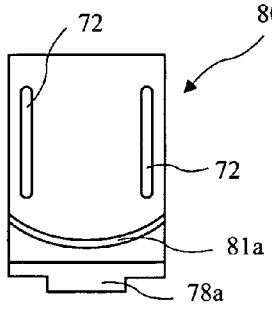
FIG. 14A is a top view of a first (or upper) tile.
Figure 14B:
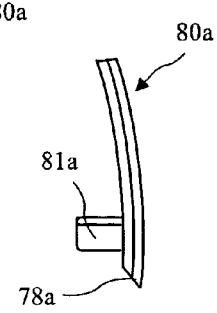
FIG. 14B is a side view of the first (or upper) tile.
Figure 14C:
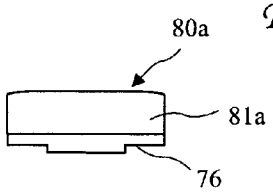
FIG. 14C is a face view of the first (or upper) tile.

A top view of a first (or upper) tile 80*a* is shown in FIG. 14A, a side view of the first (or upper) tile 14*a* is shown in FIG. 14B, and a face view of the first (or upper) tile 80*a* is shown in FIG. 14C. The tile 80*a* includes tile slots 72, a rounded wide tile bumper 81*a*, and a first underface 78*a*.

Figure 15A:
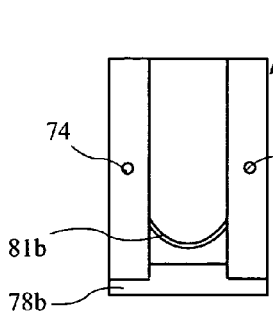
FIG. 15A is a top view of a second (or lower) tile.
Figure 15B:
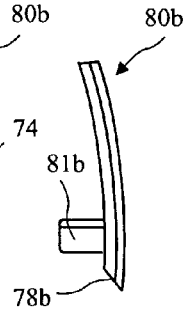
FIG. 15B is a side view of the second (or lower) tile.
Figure 15C:
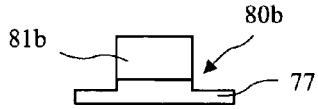
FIG. 15C is a face view of the second (or lower) tile.

A top view of a second (or lower) tile 80*b* is shown in FIG. 15A, a side view of the second (or lower) tile 80*b* is shown in FIG. 15B, and a face view of the second (or lower) tile 80*b* is shown in FIG. 15C. The tile 80*b* includes a pin 74 adapted to cooperate with the slot 72, a rounded narrow tile bumper 81*b*, and a second underface 78*b*. The tile 80*a* includes overlap portions 76 which cooperate with underlap portions 77 of the tile 80*b* to longitudinally seal adjacent tiles 80*a* and 80*b* (see FIG. 18).

Figure 16A:
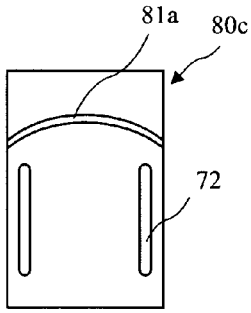
FIG. 16A is a top view of a third (or opposing upper) tile.
Figure 16B:
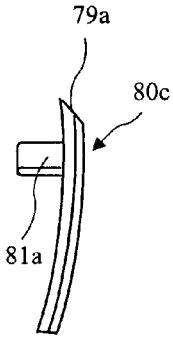
FIG. 16B is a side view of the third (or opposing upper) tile.

A top view of a third (or opposing upper) tile 80*c* is shown in FIG. 16A and a side view of the third (or opposing upper) tile 80*c* is shown in FIG. 16B. The tile 80*c* includes the tile slots 72, a rounded wide bumper 81*a*, and a first overface 79*a*.

Figure 17A:
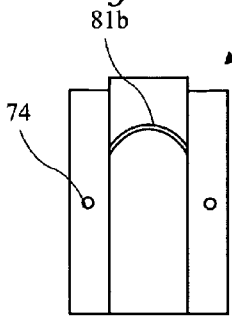
FIG. 17A is a top view of a fourth (or opposing lower) tile.
Figure 17B:
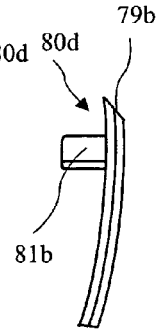
FIG. 17B is a side view of the fourth (or opposing lower) tile.

A top view of a fourth (or opposing lower) tile 80*d* is shown in FIG. 17A and a side view of the fourth (or opposing lower) tile 80*d* is shown in FIG. 17B. The tile 80*d* includes a pin 74 adapted to cooperate with the slot 72, a rounded narrow tile bumper 81*b*, and a second overface 79*b*. The tile 80*c* includes overlap portions 76 which cooperate with underlap portions 77 of the tile 80*d* to longitudinally seal adjacent tiles 80*c* and 80*d*. The overfaces 79*a* and 79*b* cooperate with the underfaces 78*a* and 78*b* to form a seal when the tiles 80*a*-80*d* meet to close the slot 84 (see FIG. 5A). The tiles 80*a*-80*d* are curved to approximately match the curvature of the outer duct 32*c* interior.

Figure 18:
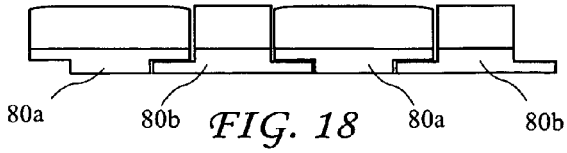
FIG. 18 is a face view of the first (or upper) tiles in longitudinal cooperation with the second (or lower) tiles.

A face view of the upper tiles 80*a* (or 80*c*) in longitudinal cooperation with the lower tiles 80*b* (or 80*d*) is shown in FIG. 18, wherein overlaps 76 and underlaps 77 cooperate to longitudinally close the slot 84.

Figure 19A:
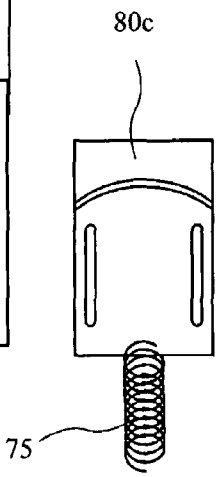
FIG. 19A shows a tile with a spring biasing the tile into a closed position.
Figure 19:
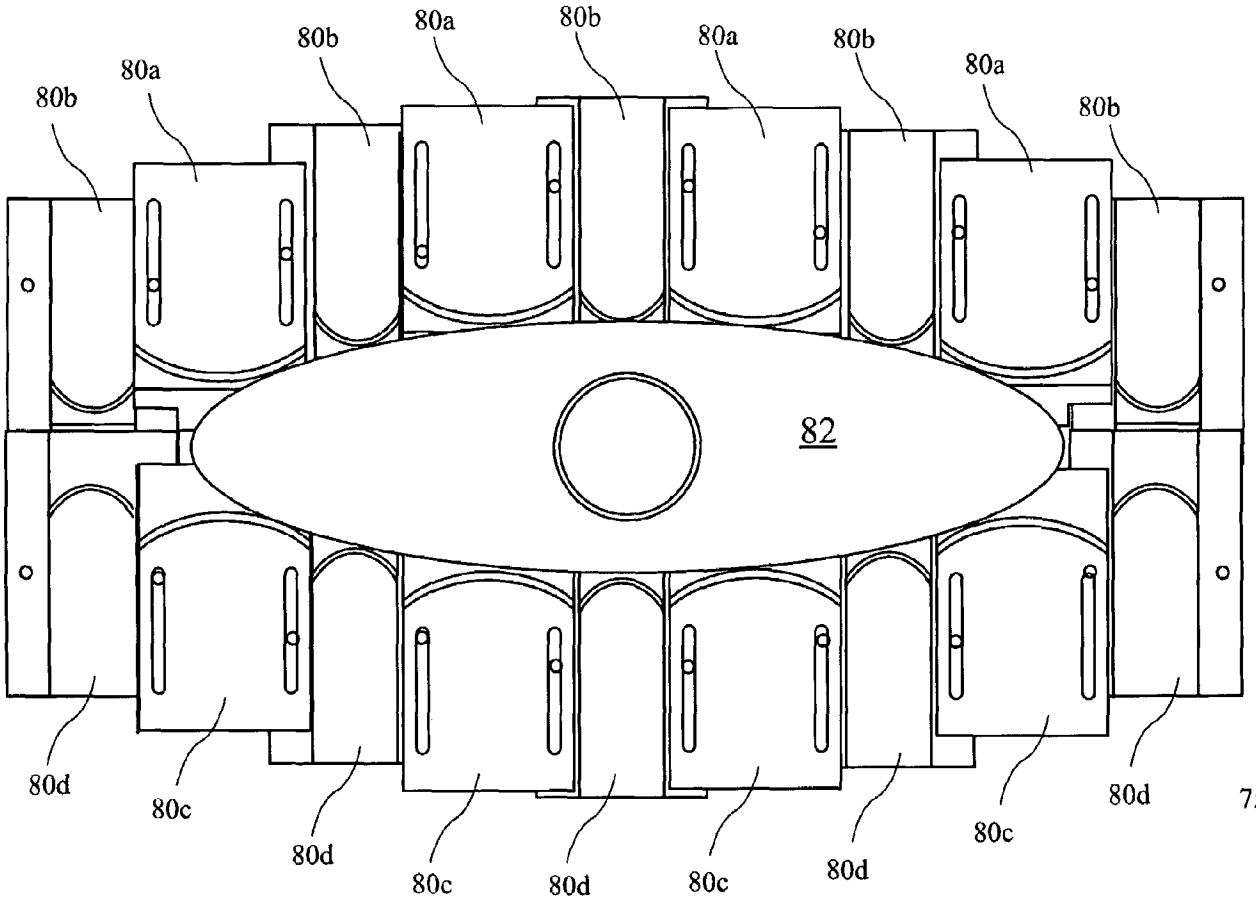
FIG. 19 shows the tiles spread apart by the duct transport unit.

The tiles 80*a*-80*d* are shown spread apart by the duct transport unit 82 in FIG. 19. The pins 74 and slots 72 cooperate to help hold the tiles 80*a*-80*d* in position. The transport unit bumper 82*a* (see FIGS. 13B and 13D) cooperates with the tile bumpers 81*a* and 81*b* (see FIGS. 14A-17B) to slide the tiles 80*a*-80*d* apart as the duct transport unit 82 translates longitudinally through the horizontal duct 32*a*. The tiles 80*a*-80*d*, bumpers 81*a* and 81*b*, and duct transport unit 82 are preferably made of steel with a coating or surfacing material such as a Teflon® coating, Silicone, or Silverstone® coating. The Teflon® coating preferably comprises a two-layer system comprising a primer and a topcoat, and the Silverstone® coating comprises a three-layer system comprising a primer, a midcoat, and a topcoat. Generally, a Silverstone® coating is thicker, harder, and more durable than a Teflon® coating, but is otherwise similar to a Teflon® coating. A tile spring 75 for biasing the tile into a closed position is shown in FIG. 19A. Such tile spring 75 may be used with some or all of the tiles 80*a*-80*d* to bias the tiles into firm lateral cooperation to better close the slot 84.

Figure 20A:
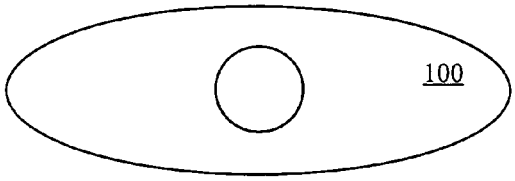
FIG. 20A is a top view of a second duct transport unit.
Figure 20C:
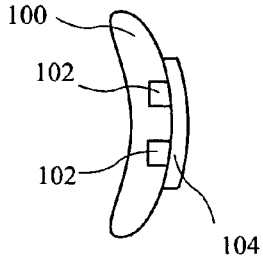
FIG. 20C is a front view of a second duct transport unit.
Figure 20B:
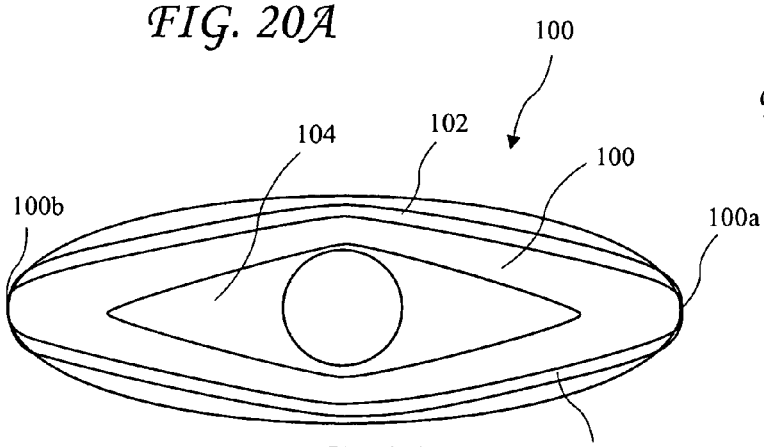
FIG. 20B is a bottom view of a second duct transport unit.

A top view of a second duct transport unit 100 is shown in FIG. 20A, a bottom view of the second duct transport unit 100 is shown in FIG. 20B, and a front view of the second duct transport unit 100 is shown in FIG. 20C. The duct transport unit 100 includes channels 102 running longitudinally along a bottom surface from a leading end 100*a* to a trailing end 100*b*. A transport unit guide 104 resides on the bottom of the duct transport unit 100 for cooperation with the bottom gap 84 (see FIGS. 5A and 5B).

Figure 21:
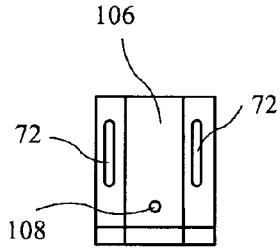
FIG. 21 is a second tile suitable for cooperation with the second duct transport unit.
Figure 21A:
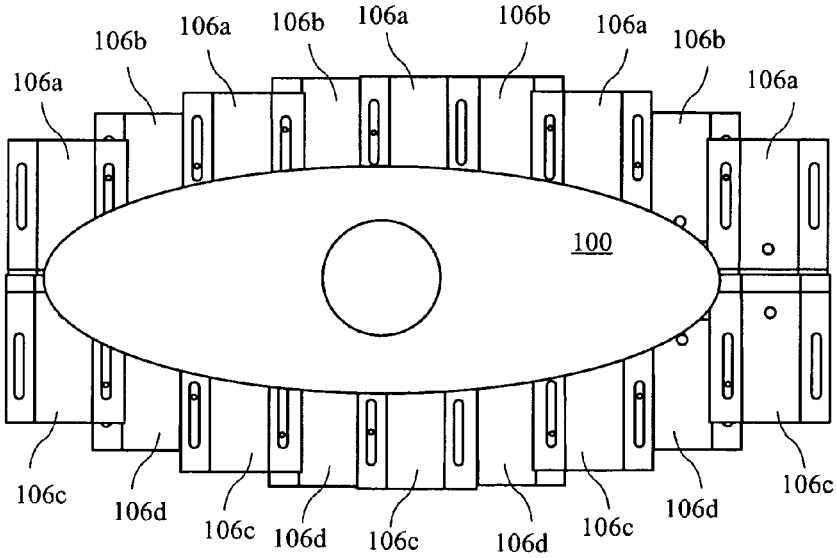
FIG. 21A shows several of the second tiles in cooperation with the duct transport unit.

A second tile 106 with a guide 108 is shown in FIG. 21, and several tiles 106*a* through 106*d* are shown in cooperation with the duct transport unit 100 in FIG. 21A. The tiles 106*c* and 106*d* cooperate with each other in the same manner as tiles 80*a* through 80*d* (see FIG. 19). The tiles 106 preferably include cooperating surfaces 76, 77, 78*a*, 78*b*, 79*a*, and 79*b* shown in FIGS. 14A-17B, slots 72, and additionally a guide 108 which cooperates with one of the channels 102 to open and close the tiles 106 to allow the duct transport unit 100 to translate through the duct 32*a* (see FIGS. 4, 5A, 5B, and 6). The cooperation of the guides 108 with the channels 102 replaces the cooperation of the bumpers 81 with the transport unit bumper 82*a* (see FIG. 19). The guides 108 may be pins, slides, wheels, rollers, or the like, and may be any structure suitable for cooperation with the channels 102.

Figure 23C:
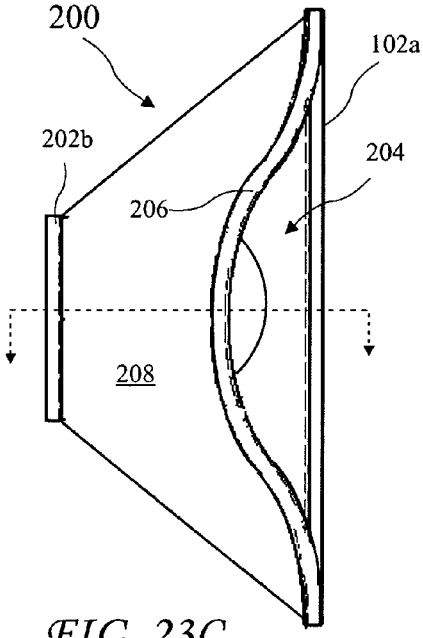
FIG. 23C is a top view of the third duct transport unit.
Figure 22:
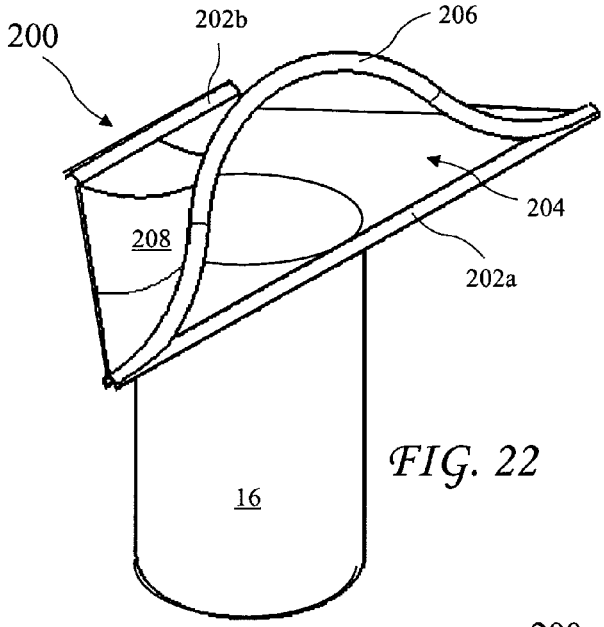
FIG. 22 is a perspective view of a third duct transport unit according to the present invention.
Figure 23A:
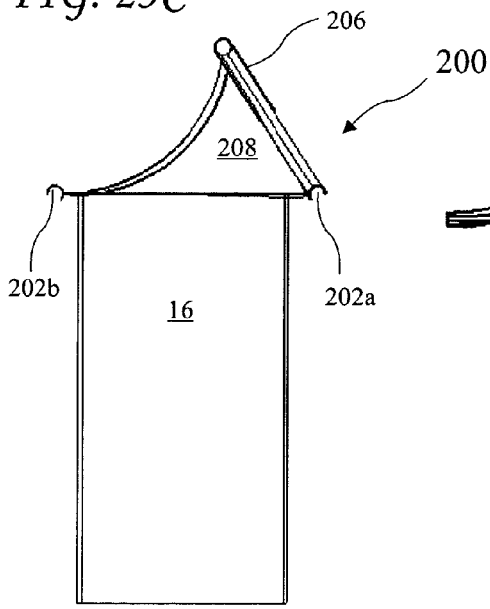
FIG. 23A is a side view of the third duct transport unit.
Figure 23B:
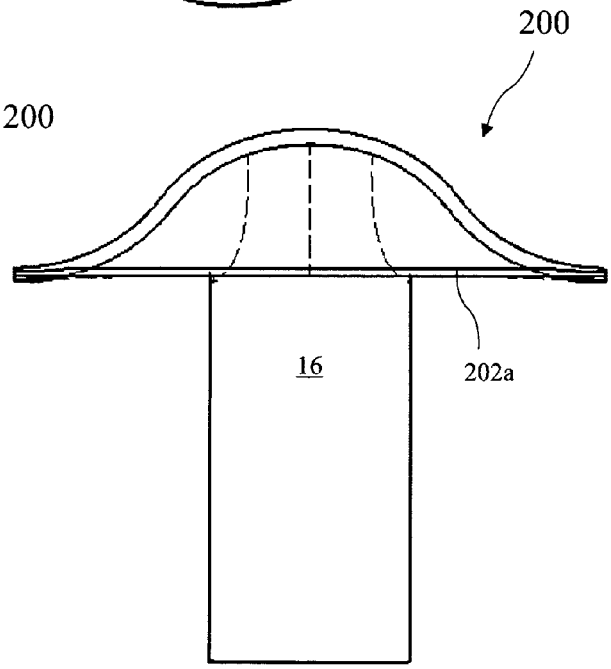
FIG. 23B is a front view of the third duct transport unit.

A perspective view of a third duct transport unit 200 according to the present invention is shown in FIG. 22. A side view of the third duct transport unit 200 is shown in FIG. 23A, a front view of the third duct transport unit 200 is shown in FIG. 23B, and a top view of the third duct transport unit 200 is shown in FIG. 23C. The duct transport unit 200 includes front guide 202*a* and rear guide 202*b*. The guides 202*a* and 202*b* preferably comprise high temperature graphite bushings. A mouth 204 is supported by a mouth frame 206 and a transport unit cover 208 resides between the mouth frame 206 and the rear guide 202*b*. The vertical duct 16 extends downward from the transport unit 200 and is described above. The duct 16 may be supported by the duct supports 50*a*, 50*b* (see FIGS. 10, 11*b*).

Figure 24:
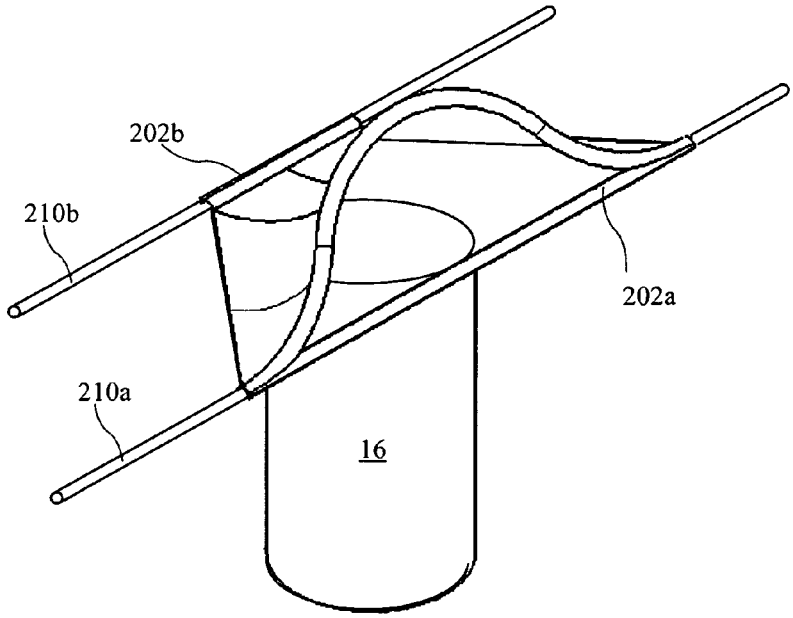
FIG. 24 is a perspective view of the third duct transport unit residing on rails.

A perspective view of the duct transport unit 200 residing on front rail 210*a* and rear rail 210*b* is shown in FIG. 24. The guides 202*a* and 202*b* slide on the rails 210*a* and 210*b* to allow motion of the duct transport unit 200. The mouth 204 is seen to rise diagonally into the interior of the interior of the horizontal duct 32*a*.

Figure 25:
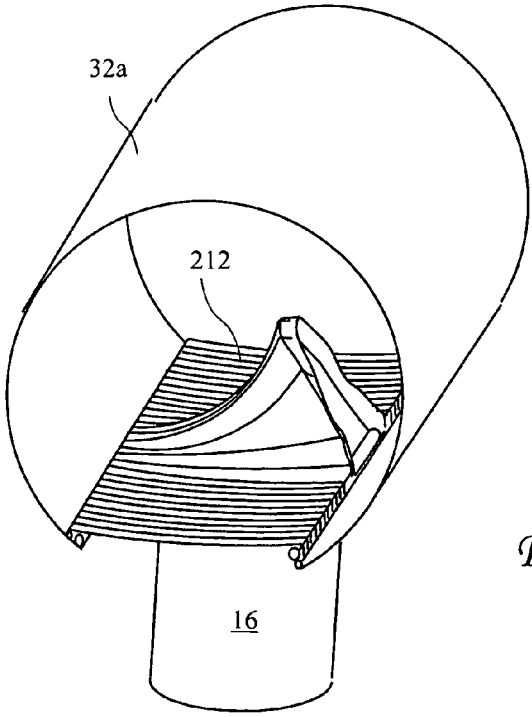
FIG. 25 is a perspective view of the third duct transport unit residing in a horizontal duct and displacing a curtain.

A perspective view of the third duct transport unit 200 residing in the horizontal duct 32*a* and displacing a curtain 212 is shown in FIG. 25. The curtain 212 is preferable a high temperature fabric and more preferably layers of fiberglass with a Teflon® material coated fiberglass as the outermost layer. As the duct transport unit 200 translates through the horizontal duct 32*a*, the curtain 212 is lifted by the frame 206 to allow the mouth 204 to fluidly communicate with the interior of the horizontal duct 32*a*. Before and after the duct transport unit 200 the curtain closes the horizontal duct 32*a* to limit or prevent the escape of gasses from the horizontal duct 32*a*.

Figure 26:
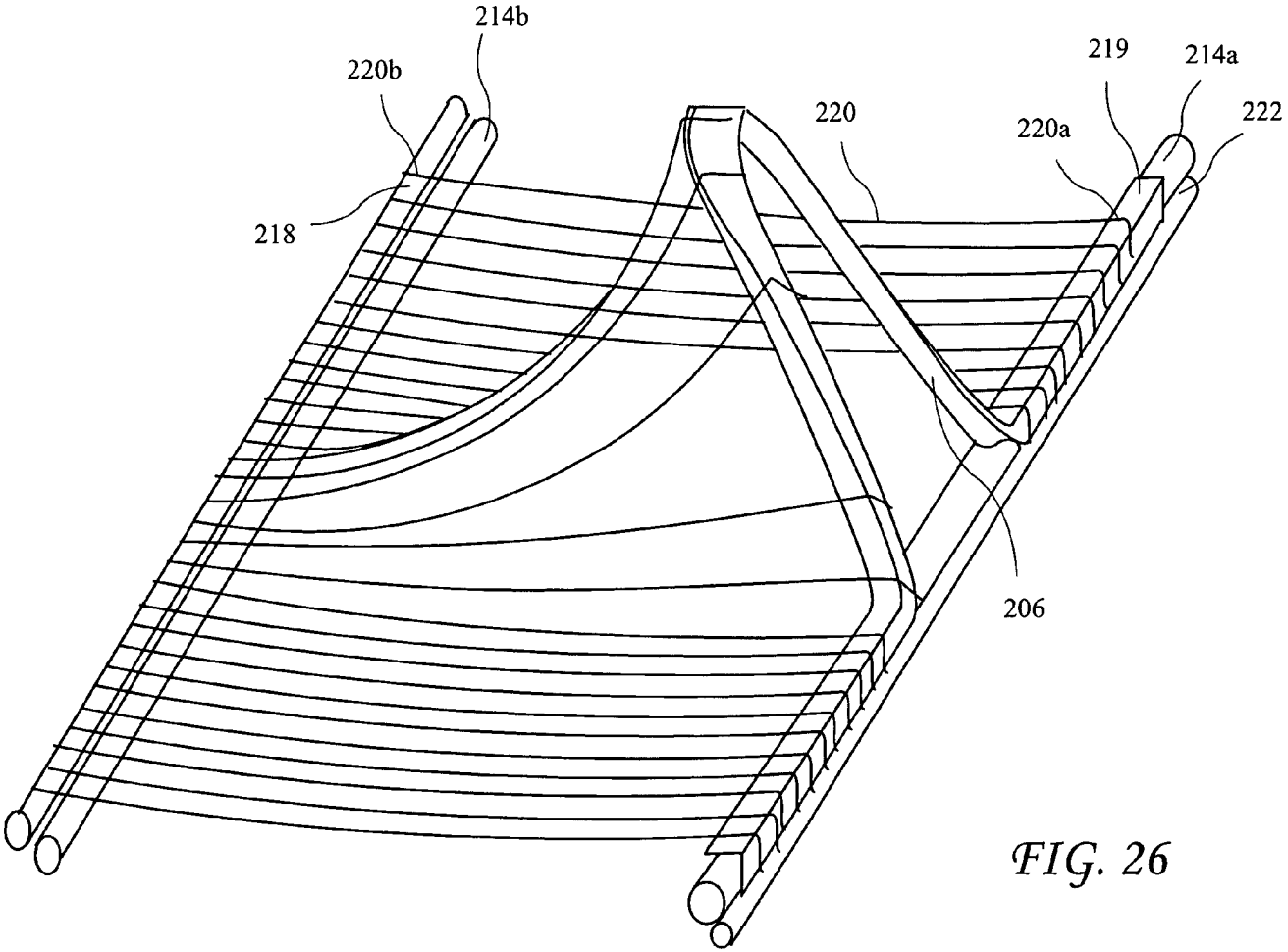
FIG. 26 shows details of the displacement of curtain springs displaced by the motion of the third duct transport unit.

A detailed view of the cooperation of the duct transport unit 200 with the horizontal duct 32*a* and curtain 212 is shown in FIG. 26. The curtain 212 is omitted to show a multiplicity of curtain springs 220 displaced by the motion of the third duct transport unit 200 through the duct 32*a*. The curtain springs 220 extend across the otherwise open base of the horizontal duct 32*a* and are preferably "L" shaped flat springs sewn into high temperature fabric. A rear end 220*b* of the curtain springs 220 attaches to a curtain support 218 located behind and above the rear rail 214*b*. A front end 220*a* of the curtain springs 220 is supported by the front rail 214*a*, and preferably by a high temperature graphite seal 219 supported by the front rail 214*a*. The seal 219 is preferably substantially square and attached to the front end 220*a*, thus the curtain springs both support the curtain 212 and position the seal 219 on the front rail 214*a*.

As the duct transport unit 200 travels through the duct 32*a*, the seal 219 rides up and over the frame 206 (see FIG. 22), thus the frame 206 serves as a guide for the seal 219 and for the curtain springs 220.

Figure 27:
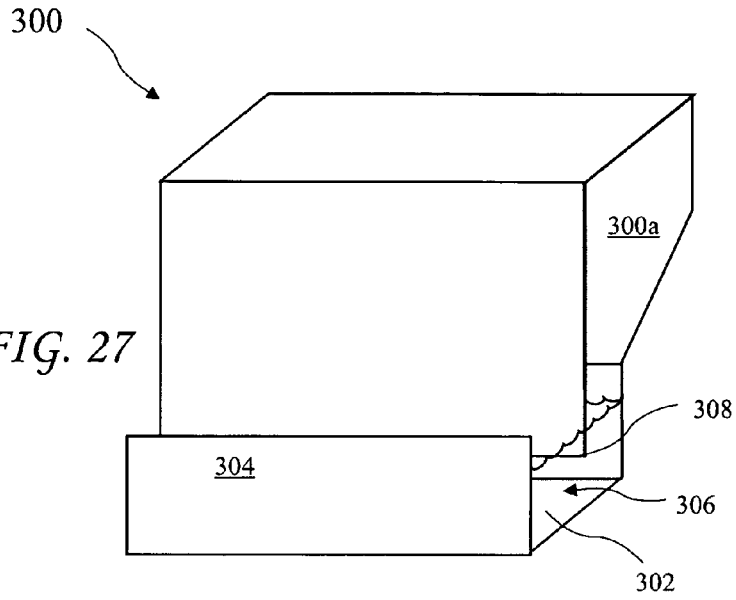
FIG. 27 is a perspective view of a section of a water sealed horizontal duct.
Figure 28:
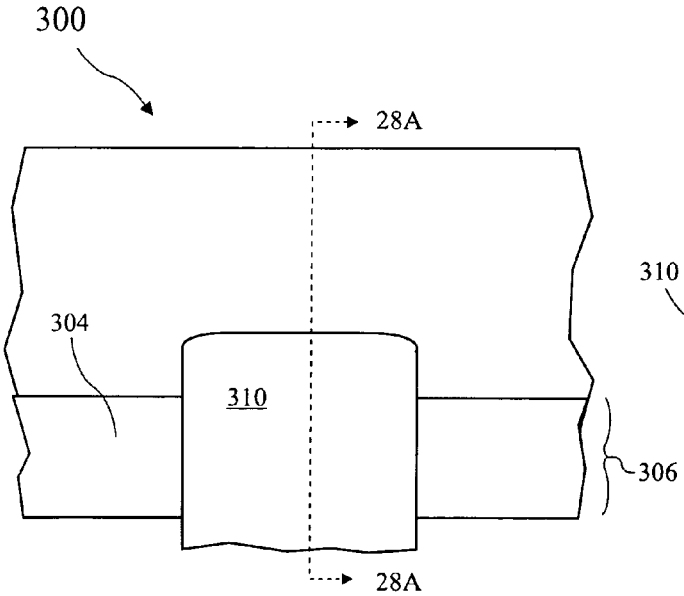
FIG. 28 is a side view of the water sealed horizontal duct with a snorkel.
Figure 28A:
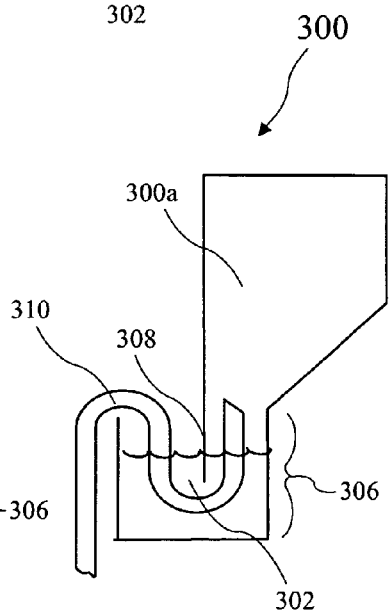
FIG. 28A is a cross-sectional view of the water sealed horizontal duct and snorkel taken along line 28A-28A of FIG. 28.

A perspective view of a section of a liquid sealed horizontal duct 300 is shown in FIG. 27. A side view of the liquid sealed horizontal duct 300 with a snorkel 310 is shown in FIG. 28, and a cross-sectional view of the liquid sealed horizontal duct 300 and snorkel 310 taken along line 28A-28A of FIG. 28 is shown in FIG. 28A. The duct 300 includes a main portion 300*a* carrying fumes to the ECU 18 (see FIG. 2). A wall 304 forms a trough 306 containing a liquid 302. The liquid 302 is preferably water, and the duct 300, and trough 306 are preferably made from stainless steel. A divider 308 extends downward into the trough 306 and into the liquid 302 to provide a seal against escape of fumes from the main portion 300*a*. A snorkel 310 includes a sideways "S" which cooperates with the trough 306 and divider 308 to place the vertical duct 16 (not shown) in fluid communication with the main portion 300*a*. Such cooperation allows locomotive exhaust to enter the main portion 300*a* while preventing the escape of fumes from the main portion 300*a*, and allows motion of the duct 16. The snorkel 310 is preferably made from stainless steel.

Figure 29C:
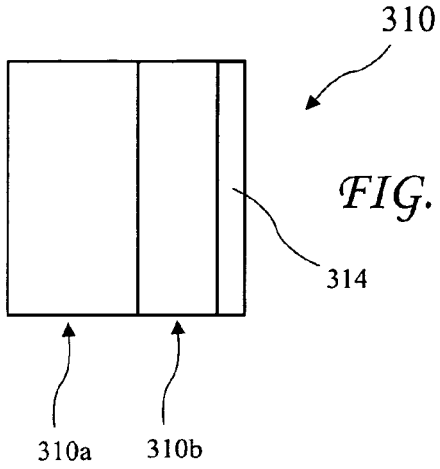
FIG. 29C is a top view of the snorkel alone.
Figure 29A:
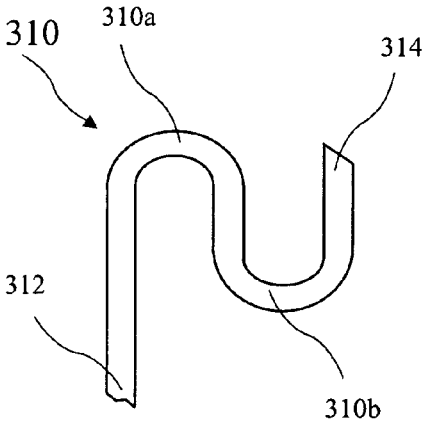
FIG. 29A is a front view of the snorkel alone.
Figure 29B:
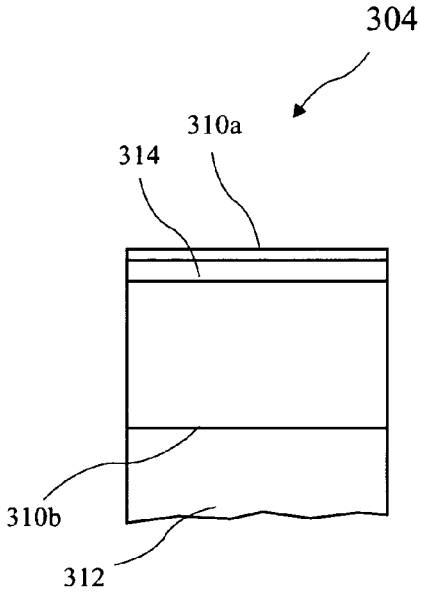
FIG. 29B is a side view of the snorkel alone.

A front view of the snorkel 310 is shown in FIG. 29A, a side view of the snorkel 310 is shown in FIG. 29B, and .a top view of the snorkel 310 is shown in FIG. 29C. The snorkel 310 includes a wall portion 310*a* and a divider portion 310*b*. The wall portion 310*a* is sufficiently high to ride over the wall 304. The divider portion 310*b* is sufficiently vertically displaced from the wall portion 310*a* to pass under the divider 308, but not vertically displaced too greatly to interfere with the trough 306.

Figure 30B:
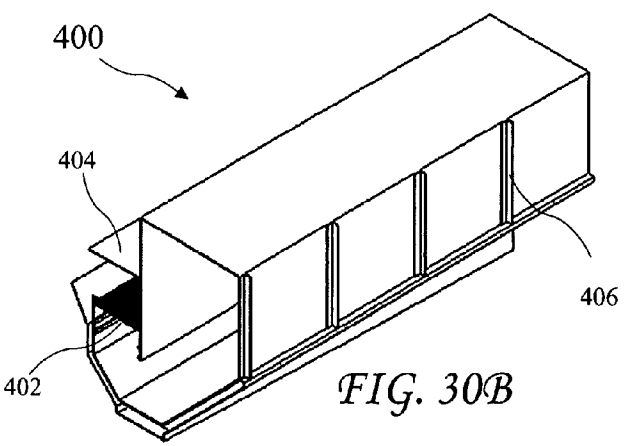
FIG. 30B is a rear quarter perspective view of the second embodiment of the water sealed horizontal duct.
Figure 30A:
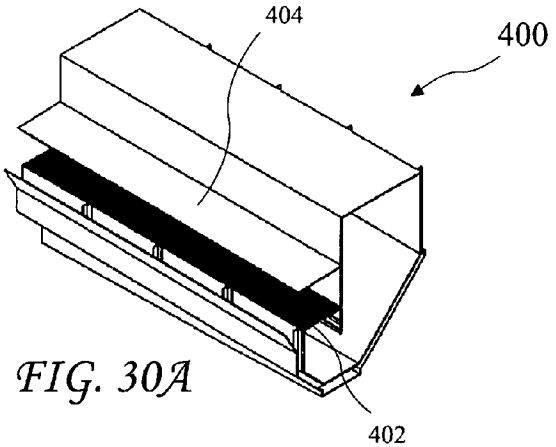
FIG. 30A is a front quarter perspective view of a second embodiment of a water sealed horizontal duct according to the present invention.
Figure 31B:
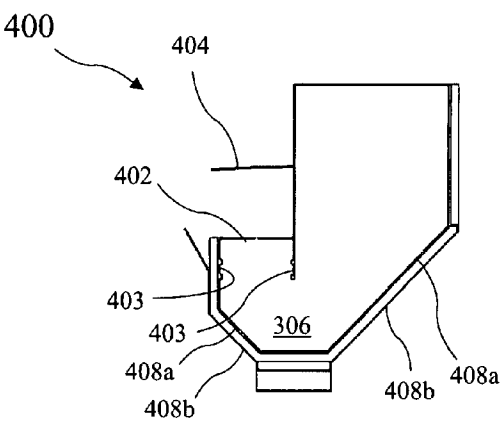
FIG. 31B is an end view of the second embodiment of the water sealed horizontal duct.
Figure 31A:
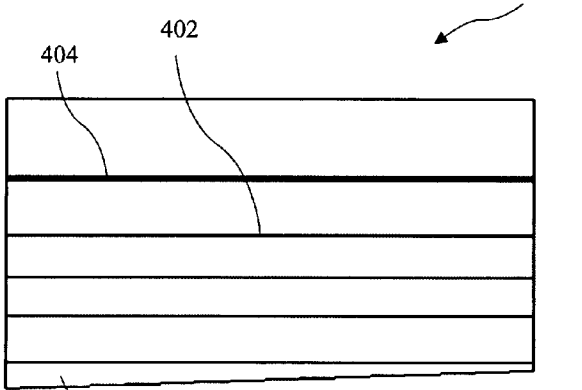
FIG. 31A is a front view of the second embodiment of the water sealed horizontal duct.

A front quarter perspective view of a second embodiment of a liquid sealed horizontal duct 400 is shown in FIG. 30A and a rear quarter perspective view of the second embodiment of the liquid sealed horizontal duct 400 is shown in FIG. 30B. A front view of the second embodiment of the liquid sealed horizontal duct is shown in FIG. 31A and an end view of the second embodiment of the liquid sealed horizontal duct is shown in FIG. 31B.

The duct 400 includes an inner skin 408*a*, and outer skin 408*b*, framing 406, splash containment brushes 402, a hood 404, and bushing guide rails 403. The brushes 402 are located above the entrance to the trough 306 (see FIGS. 27 and 28*a*) to contain the liquid during any splashing from movement of the snorkel 410 (see FIG. 32). The brushes 402 contain the splashing, while still allowing for movement of the snorkel 410. A hood 404 resides above the brushes 402 to prevent any debris from entering the trough 306. The hood 404 also acts to condense any liquid which evaporates out of the trough 306 due to the high temperature of the locomotive exhaust. The hood 404 is angled to return the condensed liquid back to the trough and minimize liquid loss. An angled containment tray 409 resides beneath the trough 306. In the event of a leak in the inner skin 408*a* of the trough 306, the liquid will be contained within the outer skin 408*b* and carried via the angled containment tray 409 to a reservoir and/or to a drainage system (not shown). Bushing guide rails 403 are provided below the brushed 402 guide and/or support the snorkel 410 within the trough via bushings 412 located on the snorkel. The snorkel 410 is thus guided to move longitudinally along the duct 400 while being restrained from unintended motion in other directions.

Figure 32:
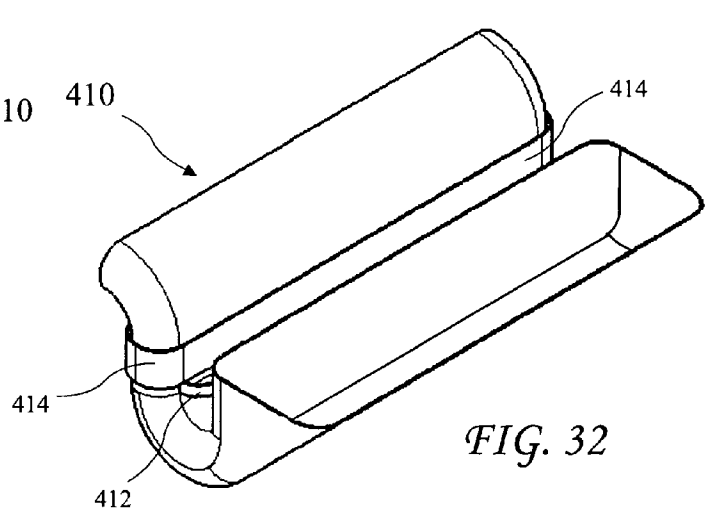
FIG. 32 is a rear quarter perspective view of a second embodiment of the snorkel according to the present invention.
Figure 33B:
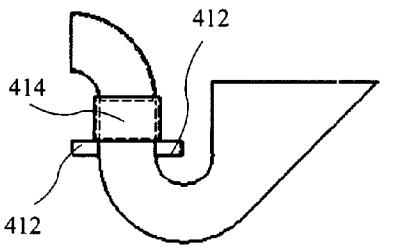
FIG. 33B is a side view of the second snorkel.
Figure 33C:
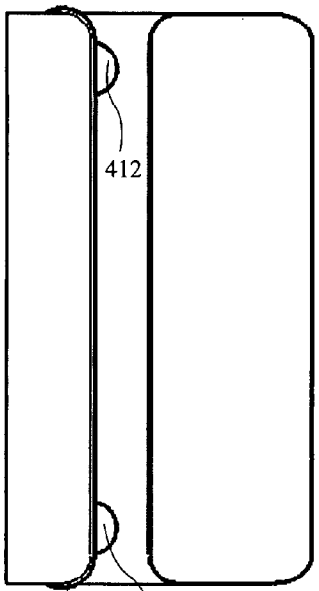
FIG. 33C is a top view of the second snorkel.
Figure 33A:
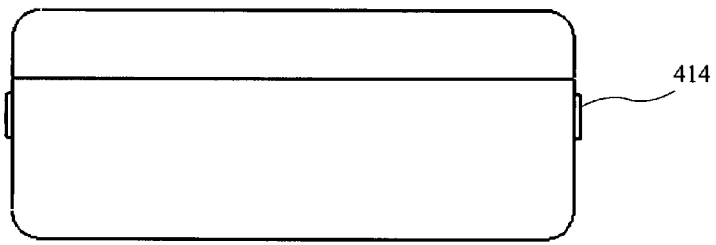
FIG. 33A is a front view of the second embodiment of the second snorkel.

A rear quarter perspective view of a second embodiment of the snorkel 410 is shown in FIG. 32, a front view of the snorkel 410 is shown in FIG. 33A, a side of the snorkel 410 is shown in FIG. 33B, and a top view of the snorkel 410 is shown in FIG. 33C. Bushings 412 are located on the extreme ends of the snorkel 410. The bushings 412 ride along bushing guide rails 403 (see FIG. 31B) located in the trough 306. The bushings 412 guide the snorkel 410 to move along the duct 400 while being restrained all other directions. A brush thermal separation barrier 414 resides on the snorkel 410 to provide a cooler surface (compared to the snorkel body) to push against the splash containment brushes 402 (see FIGS. 30A and 30B). The barrier 414 is separated from the main body of the snorkel 410 via an insulating material. The snorkel 410 will preferably be streamlined as much as possible to minimize drag as it passes through the liquid.

Figure 34:
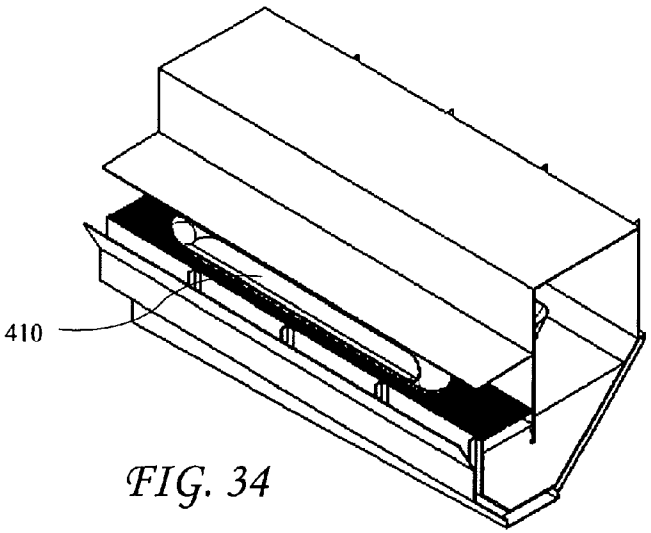
FIG. 34 is a front quarter perspective view of the second snorkel in the duct.
Figure 35B:
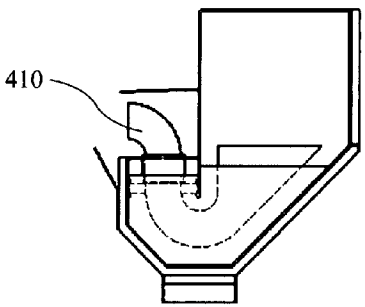
FIG. 35B is an end view of the second snorkel in the duct.
Figure 35A:
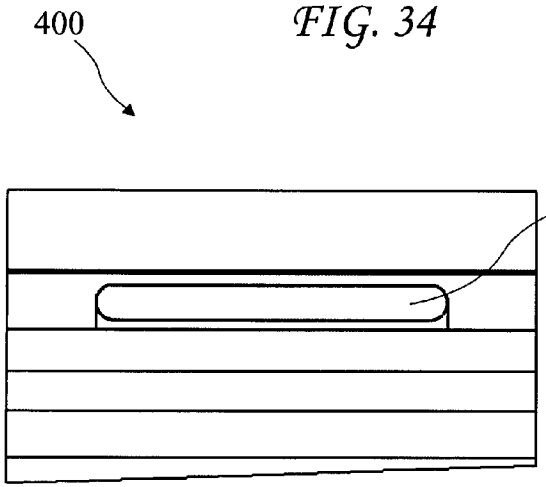
FIG. 35A is a front view of the second snorkel in the duct.

A front quarter perspective view of the second snorkel 410 in the duct 400 is shown in FIG. 34, a front view of the second snorkel 410 in the duct 400 is shown in FIG. 35A, and an end view of the second snorkel 410 in the duct 400 is shown in FIG. 35B.

Figure 36:
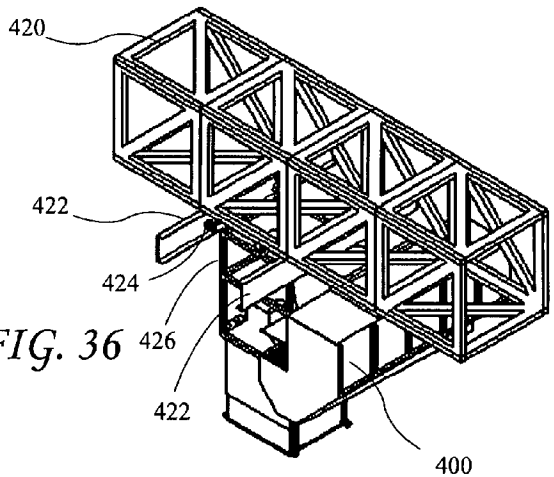
FIG. 36 is a front quarter perspective view of a duct and snorkel support according to the present invention, supporting the duct and the snorkel.
Figure 37B:
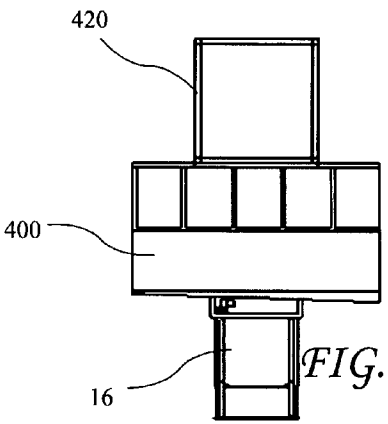
FIG. 37B is a side view of the duct and snorkel support supporting the duct and the snorkel.
Figure 37C:
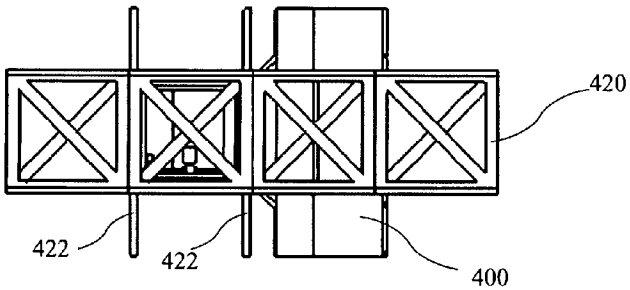
FIG. 37C is a top view of the duct and snorkel support supporting the duct and the snorkel.
Figure 37A:
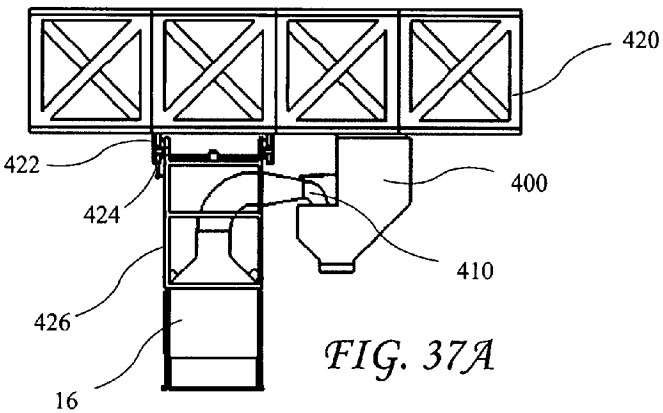
FIG. 37A is a front view of the duct and snorkel support supporting the duct and the snorkel.

A rear quarter perspective view of a duct and snorkel support 420 according to the present invention, supporting the duct 400 and the snorkel 410 is shown in FIG. 36, a front view of the duct and snorkel support 420 supporting the duct 400 and the snorkel 410 is shown in FIG. 37A, a side view of the duct and snorkel support 420 supporting the duct 400 and the snorkel 410 is shown in FIG. 37B, and a top view of the duct and snorkel support 420 supporting the duct 400 and the snorkel 420 is shown in FIG. 37C. Tracks 422 are attached to the support 420, and rollers 424 roll in the tracks and carry a trolley 426 which the vertical duct 16 is supported by.

Figure 38A:
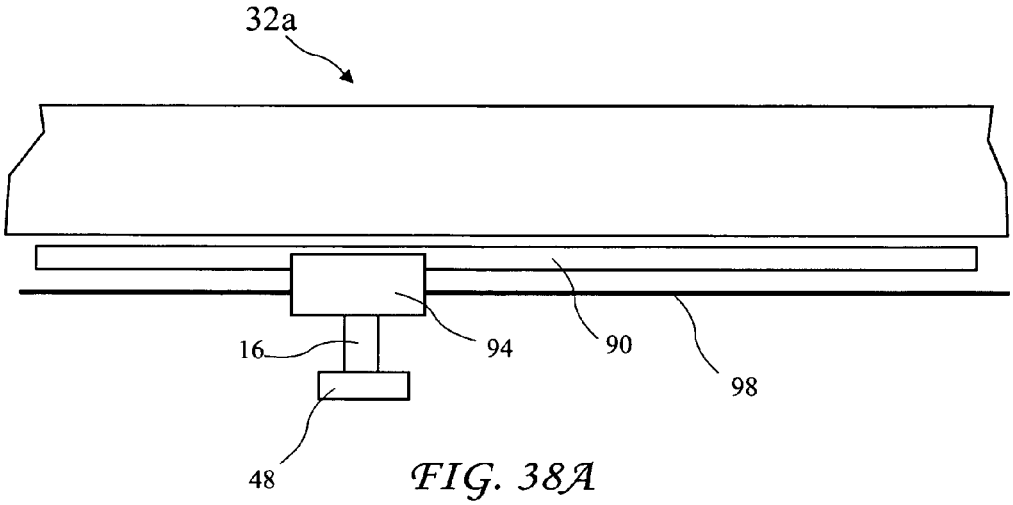
FIG. 38A shows a cable provided to pull the vertical duct along the horizontal duct.
Figure 38B:
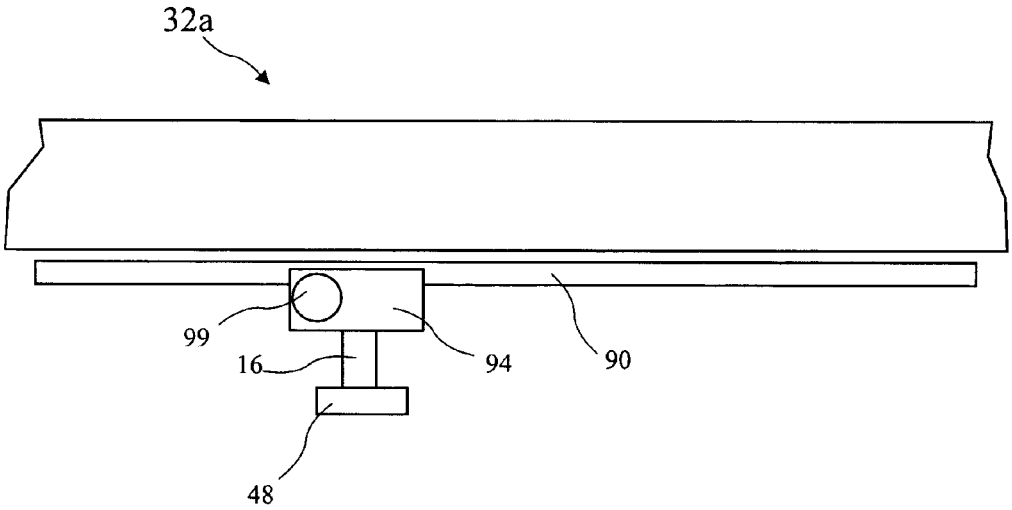
FIG. 38B shows a motor provided to move the vertical duct along the horizontal duct.

The vertical duct 16 or 70 may be pulled along the horizontal duct 32*a* by the locomotive 10, or means may be provided to position the vertical duct 16 or 70 approximately above the exhaust pipe 12*a* or 12*b*. For example, a cable 98 may be provided to pull the vertical duct 16 or 70 or the duct transport unit 82 along the horizontal duct 32*a* as shown in FIG. 38A, or a transport unit motor 99 may be provided to move the vertical duct 16 or 70 or the duct transport unit 82 along the horizontal duct 32*a* as shown in FIG. 38B.

Figure 39A:
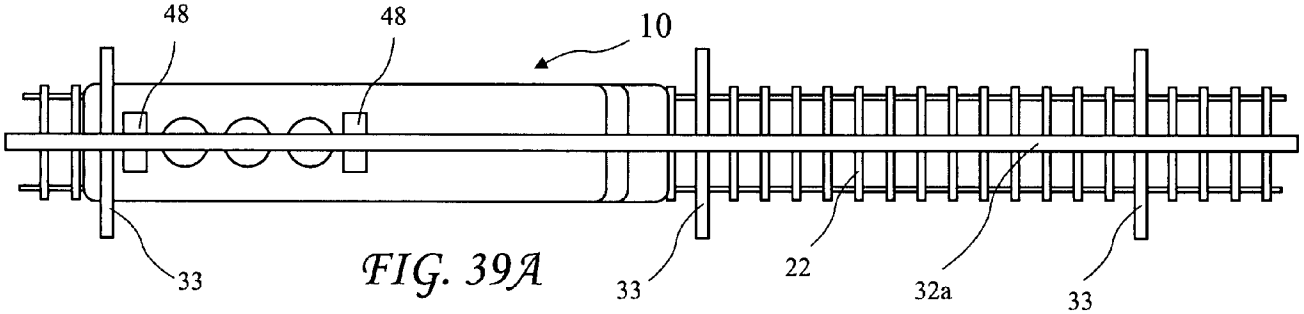
FIG. 39A shows a top view of the locomotive and horizontal duct.
Figure 39B:
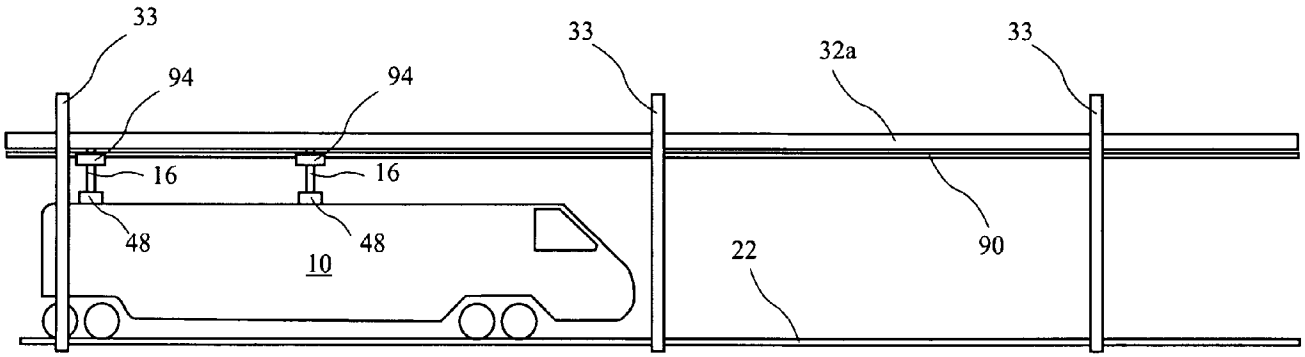
FIG. 39B shows a side view of the locomotive and horizontal duct.

A top view of the locomotive 10 and horizontal duct 32*a* is shown in FIG. 39A, and a side view of the locomotive 10 and horizontal duct 32*a* is shown in FIG. 39B. Thus connected, the locomotive 10 may move through a rail yard, a freight yard, a port, or the like, and remain attached to the ECU 18, thereby reducing the harmful emissions of the locomotive.

Often, two or more locomotive engines are coupled in joint operation, or a single locomotive may have two or more exhaust pipes, and a system having bonnets, ducts, and ECUs for processing locomotive exhaust simultaneously from two or more locomotives and/or locomotives with two or more exhaust pipes is intended to come within the scope of the present invention.

While the invention herein disclosed has been described by means of specific embodiments and applications thereof, numerous modifications and variations could be made thereto by those skilled in the art without departing from the scope of the invention set forth in the claims.

We claim:

1. A system for capturing and processing exhaust from a moving vehicle, the system comprising:

an Emissions Control Unit (ECU) configured to reduce pollutants in engine exhaust flowing through the ECU;

a stationary horizontal duct including a lengthwise running slot and residing along a vehicle path, the horizontal duct in fluid communication with the ECU;

a bonnet for capturing exhaust from the moving vehicle;

a vertical duct for placing the bonnet in fluid communication with the horizontal duct through the slot, wherein the vertical duct is adapted to translate along the horizontal duct, and is positionable to allow positioning the bonnet over an exhaust pipe of the vehicle for capturing exhaust from the moving vehicle, the ECU processing the exhaust to reduce pollutants in the exhaust before the exhaust is released to the atmosphere;

a duct transport unit translating along the horizontal duct with the vertical duct and interfacing the vertical duct to the horizontal duct; and two longitudinally extending rows of side by side tiles residing in the stationary horizontal duct, the two rows of tiles opposing each other and sliding together laterally to close the lengthwise running slot, the rows of tiles comprising alternating upper tiles with overlapping edges and lower tiles with underlapping edges, wherein the cooperation of the overlapping edges with the underlapping edges close the slot, the tiles closing laterally before and after the duct transport unit for sealing the slot in front of the duct transport unit and behind the duct transport unit.

2. The system of claim 1, wherein the lower tiles include pins and the upper tiles include slots, and the pins engage the slots to hold the tiles in position.

3. The system of claim 1, wherein the opposing tiles include tile bumpers and the duct transport unit includes a transport unit bumper, wherein the transport unit bumper cooperates with the tile bumpers to push the opposing tiles apart as the duct transport unit moves along the horizontal duct.

4. The system of claim 3, wherein the transport unit bumper is substantially elliptical and the tile bumpers are rounded.

5. The system of claim 1, wherein the transport unit includes longitudinally running channels and the tiles include guides, wherein the guides cooperate with the channels to open and close the tiles when the transport unit translates through the duct.

6. The system of claim 1, wherein the slot is in the bottom of the horizontal duct.

7. The system of claim 1, wherein the vertical duct comprises a telescoping vertical duct adapted to lengthen to lower the bonnet over the exhaust pipe and to shorten to lift the bonnet away from the exhaust pipe.

8. The system of claim 7, wherein the horizontal duct and the vertical duct are supported by at least one rail residing above railroad tracks.

9. A system for capturing and processing exhaust from a moving vehicle, the system comprising:

an Emissions Control Unit (ECU) configured to reduce pollutants in engine exhaust flowing through the ECU;

a stationary horizontal duct including a lengthwise running slot and residing along a vehicle path, the horizontal duct in fluid communication with the ECU;

a bonnet for capturing exhaust from the moving vehicle;

a vertical duct for placing the bonnet in fluid communication with the horizontal duct through the slot, wherein the vertical duct is adapted to translate along the horizontal duct, and is positionable to allow positioning the bonnet over an exhaust pipe of the vehicle for capturing exhaust from the moving vehicle, the ECU processing the exhaust to reduce pollutants in the exhaust before the exhaust is released to the atmosphere;

a duct transport unit translating along the horizontal duct with the vertical duct and interfacing the vertical duct to the horizontal duct; and two longitudinally extending rows of side by side tiles residing in the stationary horizontal duct, the two rows of tiles opposing each other and sliding laterally together to close before and after the duct transport unit for sealing the lengthwise running slot in front of the duct transport unit and behind the duct transport unit, the tiles including tile bumpers and the duct transport unit including a transport unit bumper, wherein the transport unit bumper cooperates with the tile bumpers to push the opposing tiles apart as the duct transport unit moves along the horizontal duct.

10. The system of claim 9, wherein the tiles include cooperating side edges to longitudinally close the lengthwise running slot.

11. The system of claim 10, wherein the tiles comprise upper tiles with overlapping side edges and lower tiles with underlapping side edges, wherein the cooperation of the overlapping edges with the underlapping edges longitudinal closes the lengthwise running slot.

12. The system of claim 11, wherein the lower tiles include pins and the upper tiles include slots, and the pins engage the slots to hold the tiles in position.

13. A system for capturing and processing exhaust from a moving vehicle, the system comprising:

an Emissions Control Unit (ECU) configured to reduce pollutants in engine exhaust flowing through the ECU;

a stationary horizontal duct including a lengthwise running slot and residing along a vehicle path, the horizontal duct in fluid communication with the ECU;

a bonnet for capturing exhaust from the moving vehicle;

a vertical duct for placing the bonnet in fluid communication with the horizontal duct through the slot, wherein the vertical duct is adapted to translate along the horizontal duct, and is positionable to allow positioning the bonnet over an exhaust pipe of the vehicle for capturing exhaust from the moving vehicle, the ECU processing the exhaust to reduce pollutants in the exhaust before the exhaust is released to the atmosphere; and a duct transport unit translating along the length of the horizontal duct with the vertical duct and interfacing the vertical duct to the horizontal duct; and two longitudinally extending rows of side by side tiles residing in the stationary horizontal duct, the two rows of tiles opposing each other and sliding laterally together to close before and after the duct transport unit for sealing the lengthwise running slot in front of the duct transport unit and behind the duct transport unit, opposing faces of the tiles meeting to close the slot, the opposing faces having cooperating bevels, wherein one of the opposing faces includes a beveled underface facing up and the other one of the opposing faces includes a beveled overface facing down, and when the opposing tiles close, the beveled faces overlap to laterally close the slot.

14. The system of claim 13, wherein the tiles include cooperating side edges to close longitudinally.

15. The system of claim 13, wherein the tiles comprise upper tiles with overlapping side edges and lower tiles with underlapping side edges, wherein the cooperation of the overlapping side edges with the underlapping side edges longitudinal closes the slot.

16. The system of claim 15, wherein the lower tiles include pins and the upper tiles include slots, and the pins engage the slots to hold the tiles in position.

17. The system of claim 13, wherein the tiles include tile bumpers and the duct transport unit includes a transport unit bumper, wherein the transport unit bumper cooperates with the tile bumpers to push the tiles apart as the duct transport unit moves along the horizontal duct.

* * * * *